US010030474B2

(12) United States Patent
Themig et al.

(10) Patent No.: US 10,030,474 B2
(45) **Date of Patent: *Jul. 24, 2018**

(54) DOWNHOLE SUB WITH HYDRAULICALLY ACTUABLE SLEEVE VALVE

(71) Applicant: PACKERS PLUS ENERGY SERVICES INC., Calgary (CA)

(72) Inventors: Daniel Jon Themig, Calgary (CA); Kevin O. Trahan, The Woodlands, TX (US); Christopher Denis Desranleau, Sherwood Park (CA); Frank DeLucia, Houston, TX (US)

(73) Assignee: Packers Plus Energy Services Inc., Calgary (CA)

( * ) Notice: Subject to any disclaimer, the term of this patent is extended or adjusted under 35 U.S.C. 154(b) by 234 days.

This patent is subject to a terminal disclaimer.

(21) Appl. No.: 14/273,989

(22) Filed: May 9, 2014

(65) Prior Publication Data

US 2014/0246208 A1 Sep. 4, 2014

Related U.S. Application Data

(60) Division of application No. 12/914,731, filed on Oct. 28, 2010, now Pat. No. 8,757,273, which is a (Continued)

(51) Int. Cl.
*E21B 34/10* (2006.01)
*E21B 43/14* (2006.01)
(Continued)

(52) U.S. Cl.
CPC ..... *E21B 34/10* (2013.01); *E21B 34/102* (2013.01); *E21B 43/14* (2013.01); *E21B 43/26* (2013.01);
(Continued)

(58) Field of Classification Search
CPC .. E21B 34/10; E21B 34/102; E21B 2034/007; E21B 34/14
See application file for complete search history.

(56) References Cited

U.S. PATENT DOCUMENTS 556,669 A 3/1896 Frasch
958,100 A 5/1910 Decker
(Continued)

FOREIGN PATENT DOCUMENTS

CA 2412072 A1 5/2003
CA 2838092 A1 3/2014
(Continued)

OTHER PUBLICATIONS

238th District Court, Midland, Texas, Case No. CV44964, Exhibit 10, Deposition of William Sloane Muscroft, Edmonton, Alberta, Canada, dated Mar. 31, 2007, parts 1 and 2 for a total of 111 pages.
(Continued)

*Primary Examiner* — Catherine Loikith
(74) *Attorney, Agent, or Firm* — Bereskin & Parr LLP/S.E.N.C.R.L., s.r.l.

(57) ABSTRACT

A method for opening a port through the wall of a ported sub includes providing a sub with a port through its tubular side wall and providing a hydraulically actuable valve to cover the port. The valve can be actuable to move away from a position covering the port to thereby open the port. The method also includes increasing pressure within the sub to create a pressure differential across the valve to move the valve toward the low pressure side, while the port remains closed by the valve, and thereafter, reducing pressure within the sub to reduce the pressure differential to move valve away from a position covering the port.

16 Claims, 17 Drawing Sheets

Related U.S. Application Data continuation-in-part of application No. PCT/CA2009/000599, filed on Apr. 29, 2009, which is a continuation-in-part of application No. 12/405,185, filed on Mar. 16, 2009, now abandoned.

(60) Provisional application No. 61/048,797, filed on Apr. 29, 2008, provisional application No. 61/287,150, filed on Dec. 16, 2009.

(51) Int. Cl.
*E21B 43/26* (2006.01)
*E21B 34/00* (2006.01)

(52) U.S. Cl.
CPC ... *E21B 2034/007* (2013.01); *Y10T 137/7729* (2015.04); *Y10T 137/7787* (2015.04)

(56) References Cited

U.S. PATENT DOCUMENTS 1,510,669 A 10/1924 Halliday
1,785,277 A 12/1930 Mack
1,956,694 A 5/1934 Parrish
2,121,002 A 6/1938 Baker
2,153,034 A 4/1939 Baker
2,201,299 A 5/1940 Owsley et al.
2,212,087 A 8/1940 Thornhill
2,227,539 A 1/1941 Dorton
2,248,511 A 7/1941 Rust
2,249,511 A 7/1941 Westall
2,287,076 A 6/1942 Zachry
2,330,267 A 9/1943 Burt et al.
2,352,700 A 7/1944 Ferris
2,493,650 A 1/1950 Baker et al.
2,537,066 A 1/1951 Lewis
2,593,520 A 4/1952 Baker et al.
2,606,616 A 8/1952 Otis
2,618,340 A 11/1952 Lynd
2,659,438 A 11/1953 Schnitter
2,689,009 A 9/1954 Brainerd et al.
2,715,444 A 8/1955 Fewel
2,731,827 A 1/1956 Loomis
2,737,244 A 3/1956 Baker et al.
2,738,013 A 3/1956 Lynes
2,752,861 A 7/1956 Hill
2,753,940 A 7/1956 Bonner
2,764,244 A 9/1956 Page
2,771,142 A 11/1956 Sloan et al.
2,780,294 A 2/1957 Loomis
2,807,955 A 10/1957 Loomis
2,836,250 A 5/1958 Brown
2,841,007 A 7/1958 Loomis
2,851,109 A 9/1958 Spearow
2,860,489 A 11/1958 Townsend
2,869,645 A 1/1959 Chamberlain et al.
2,945,541 A 7/1960 Maly et al.
2,947,363 A 8/1960 Sackett et al.
3,007,523 A 11/1961 Vincent
3,035,639 A 5/1962 Brown et al.
3,038,542 A 6/1962 Loomis
3,054,415 A 9/1962 Baker et al.
3,059,699 A 10/1962 Brown
3,062,291 A 11/1962 Brown
3,068,942 A 12/1962 Brown
3,083,771 A 4/1963 Chapman
3,083,775 A 4/1963 Nielson et al.
3,095,040 A 6/1963 Bramlett
3,095,926 A 7/1963 Rush
3,122,205 A 2/1964 Brown
3,148,731 A 9/1964 Holden
3,153,845 A 10/1964 Loomis
3,154,940 A 11/1964 Loomis
3,158,378 A 11/1964 Loomis
3,165,918 A 1/1965 Loomis
3,165,919 A 1/1965 Loomis
3,165,920 A 1/1965 Loomis
3,193,917 A 7/1965 Loomis
3,194,310 A 7/1965 Loomis
3,195,645 A 7/1965 Loomis
3,199,598 A 8/1965 Loomis
3,244,234 A 4/1966 Flickinger
3,263,752 A 8/1966 Conrad
3,265,132 A 8/1966 Edwards, Jr.
3,270,814 A 9/1966 Richardson et al.
3,289,762 A 12/1966 Schell et al.
3,291,219 A 12/1966 Nutter
3,306,365 A 2/1967 Kammerer
3,311,169 A 3/1967 Hefley
3,333,639 A 8/1967 Page et al.
3,361,209 A 1/1968 Edwards, Jr.
3,427,653 A 2/1969 Jensen
3,460,626 A 8/1969 Ehrlich
3,517,743 A 6/1970 Pumpelly et al.
3,523,580 A 8/1970 Lebourg
3,552,718 A 1/1971 Schwegman
3,587,736 A 6/1971 Brown
3,645,335 A 2/1972 Current
3,659,648 A 5/1972 Cobbs
3,661,207 A 5/1972 Current et al.
3,687,202 A 8/1972 Young et al.
3,730,267 A 5/1973 Scott
3,784,325 A 1/1974 Coanda et al.
3,860,068 A 1/1975 Abney et al.
3,948,322 A 4/1976 Baker
3,981,360 A 9/1976 Marathe
4,018,272 A 4/1977 Brown et al.
4,031,957 A 6/1977 Sanford
4,044,826 A 8/1977 Crowe
4,099,563 A 7/1978 Hutchison et al.
4,143,712 A 3/1979 James et al.
4,161,216 A 7/1979 Amancharia
4,162,691 A 7/1979 Perkins
4,216,827 A 8/1980 Crowe
4,224,987 A 9/1980 Allen
4,229,397 A 10/1980 Fukuta et al.
4,279,306 A 7/1981 Weitz
4,286,662 A 9/1981 Page
4,298,077 A 11/1981 Emery
4,299,287 A 11/1981 Vann et al.
4,299,397 A 11/1981 Baker et al.
4,315,542 A 2/1982 Dockins
4,324,293 A 4/1982 Hushbeck
4,330,039 A 5/1982 Vann et al.
4,338,999 A 7/1982 Carter, Jr.
4,421,165 A 12/1983 Szarka
4,423,777 A 1/1984 Mullins et al.
4,434,854 A 3/1984 Vann et al.
4,436,152 A 3/1984 Fisher, Jr. et al.
4,441,558 A 4/1984 Welch et al.
4,469,174 A 9/1984 Freeman
4,484,625 A 11/1984 Barbee, Jr.
4,488,975 A 12/1984 Almond
4,494,608 A 1/1985 Williams et al.
4,498,536 A 2/1985 Ross et al.
4,499,951 A 2/1985 Vann
4,516,879 A 5/1985 Berry et al.
4,519,456 A 5/1985 Cochran
4,520,870 A 6/1985 Pringle
4,524,825 A 6/1985 Fore
4,552,218 A 11/1985 Ross et al.
4,567,944 A 2/1986 Zunkel et al.
4,569,396 A 2/1986 Brisco
4,576,234 A 3/1986 Upchurch
4,577,702 A 3/1986 Faulkner
4,590,995 A 5/1986 Evans
4,605,062 A 8/1986 Klumpyan et al.
4,610,308 A 9/1986 Meek
4,632,193 A 12/1986 Geczy
4,637,471 A 1/1987 Soderberg
4,640,355 A 2/1987 Hong et al.
4,645,007 A 2/1987 Soderberg
4,646,829 A 3/1987 Barrington et al.
4,655,286 A 4/1987 Wood

(56) References Cited

U.S. PATENT DOCUMENTS 4,657,084 A 4/1987 Evans
4,714,117 A 12/1987 Dech
4,716,967 A 1/1988 Mohaupt
4,754,812 A 7/1988 Gentry
4,791,992 A 12/1988 Greenlee et al.
4,794,989 A 1/1989 Mills
4,823,882 A 4/1989 Stokley et al.
4,880,059 A 11/1989 Brandell et al.
4,893,678 A 1/1990 Stokley et al.
4,903,777 A 2/1990 Jordan, Jr. et al.
4,907,655 A 3/1990 Hromas et al.
4,909,326 A 3/1990 Owen
4,928,772 A 5/1990 Hopmann
4,949,788 A 8/1990 Szarka et al.
4,967,841 A 11/1990 Murray
4,979,561 A 12/1990 Szarka
4,991,654 A 2/1991 Brandell et al.
5,020,600 A 6/1991 Coronado
5,048,611 A 9/1991 Cochran
5,103,901 A 4/1992 Greenlee
5,146,992 A 9/1992 Baugh
5,152,340 A 10/1992 Clark et al.
5,172,717 A 12/1992 Boyle et al.
5,174,379 A 12/1992 Whiteley et al.
5,180,051 A * 1/1993 Cook ..... H01H 89/08
200/292
5,181,569 A 1/1993 McCoy et al.
5,182,015 A 1/1993 Ringgenberg et al.
5,186,258 A 2/1993 Wood et al.
5,197,543 A 3/1993 Coulter
5,197,547 A 3/1993 Morgan
5,217,067 A 6/1993 Landry et al.
5,221,267 A 6/1993 Folden
5,242,022 A 9/1993 Burton et al.
5,261,492 A 11/1993 Duell et al.
5,271,462 A 12/1993 Berzin
5,325,924 A 7/1994 Bangert et al.
5,332,038 A 7/1994 Tapp et al.
5,335,732 A 8/1994 McIntyre
5,337,808 A 8/1994 Graham
5,351,752 A 10/1994 Wood
5,355,953 A 10/1994 Shy et al.
5,360,066 A 11/1994 Venditto et al.
5,375,662 A 12/1994 Echols, III et al.
5,394,941 A 3/1995 Venditto et al.
5,411,095 A 5/1995 Ehlinger et al.
5,413,180 A 5/1995 Ross et al.
5,425,423 A 6/1995 Dobson et al.
5,449,039 A 9/1995 Hartley et al.
5,454,430 A 10/1995 Kennedy et al.
5,464,062 A 11/1995 Blizzard, Jr.
5,472,048 A 12/1995 Kennedy et al.
5,479,989 A 1/1996 Shy et al.
5,499,678 A 3/1996 Surjaatmadja et al.
5,499,687 A 3/1996 Lee
5,526,880 A 6/1996 Jordan, Jr. et al.
5,533,571 A 7/1996 Surjaatmadja et al.
5,533,573 A 7/1996 Jordan, Jr. et al.
5,542,473 A 8/1996 Pringle
5,558,153 A 9/1996 Holcombe et al.
5,579,844 A 12/1996 Rebardi et al.
5,609,178 A 3/1997 Hennig et al.
5,615,741 A 4/1997 Coronado
5,641,023 A 6/1997 Ross et al.
5,701,954 A 12/1997 Kilgore et al.
5,711,375 A 1/1998 Ravi et al.
5,715,891 A 2/1998 Graham et al.
5,732,776 A 3/1998 Tubel et al.
5,775,429 A 7/1998 Arizmendi et al.
5,782,303 A 7/1998 Christian
5,791,414 A 8/1998 Skinner
5,810,082 A 9/1998 Jordan, Jr.
5,826,662 A 10/1998 Beck et al.
5,865,254 A 2/1999 Huber et al.
5,894,888 A 4/1999 Wiemers et al.
5,921,318 A 7/1999 Ross
5,934,372 A 8/1999 Muth
5,941,307 A 8/1999 Tubel
5,941,308 A 8/1999 Malone et al.
5,947,198 A 9/1999 McKee et al.
5,947,204 A 9/1999 Barton
5,954,133 A 9/1999 Ross
5,960,881 A 10/1999 Allamon et al.
6,003,607 A 12/1999 Hagen et al.
6,006,834 A 12/1999 Skinner
6,006,838 A 12/1999 Whiteley et al.
6,009,944 A 1/2000 Gudmestad
6,041,858 A 3/2000 Arizmendi
6,047,773 A 4/2000 Zeltmann et al.
6,053,250 A 4/2000 Echols
6,059,033 A 5/2000 Ross et al.
6,065,541 A 5/2000 Allen
6,070,666 A 6/2000 Montgomery
6,079,493 A 6/2000 Longbottom et al.
6,082,458 A 7/2000 Schnatzmeyer
6,098,710 A 8/2000 Rhein-Knudsen et al.
6,109,354 A 8/2000 Ringgenberg et al.
6,112,811 A 9/2000 Kilgore et al.
6,131,663 A 10/2000 Henley et al.
6,148,915 A 11/2000 Mullen et al.
6,155,350 A 12/2000 Melenyzer
6,186,236 B1 2/2001 Cox
6,189,619 B1 2/2001 Wyatt et al.
6,220,353 B1 4/2001 Foster et al.
6,220,357 B1 4/2001 Carmichael et al.
6,220,360 B1 4/2001 Connell et al.
6,227,298 B1 5/2001 Patel
6,230,811 B1 5/2001 Ringgenberg et al.
6,241,013 B1 6/2001 Martin
6,250,392 B1 6/2001 Muth
6,253,856 B1 7/2001 Ingram et al.
6,253,861 B1 7/2001 Carmichael et al.
6,257,338 B1 7/2001 Kilgore
6,279,651 B1 8/2001 Schwendemann et al.
6,286,600 B1 9/2001 Hall et al.
6,302,199 B1 10/2001 Hawkins et al.
6,305,470 B1 10/2001 Woie
6,311,776 B1 11/2001 Pringle et al.
6,315,041 B1 11/2001 Carlisle et al.
6,347,668 B1 2/2002 McNeill
6,349,772 B2 2/2002 Mullen et al.
6,388,577 B1 5/2002 Carstensen
6,390,200 B1 5/2002 Allamon et al.
6,394,184 B2 5/2002 Tolman et al.
6,446,727 B1 9/2002 Zemlak et al.
6,460,619 B1 10/2002 Braithwaite et al.
6,464,006 B2 10/2002 Womble
6,467,546 B2 10/2002 Allamon et al.
6,488,082 B2 12/2002 Echols et al.
6,491,103 B2 12/2002 Allamon et al.
6,508,307 B1 1/2003 Almaguer
6,520,255 B2 2/2003 Tolman et al.
6,543,538 B2 4/2003 Tolman et al.
6,543,543 B2 4/2003 Muth
6,543,545 B1 4/2003 Chatterji et al.
6,547,011 B2 4/2003 Kilgore
6,571,869 B1 6/2003 Pluchek et al.
6,591,915 B2 7/2003 Burris
6,634,428 B2 10/2003 Krauss et al.
6,651,743 B2 11/2003 Szarka
6,695,057 B2 2/2004 Ingram et al.
6,695,066 B2 2/2004 Allamon et al.
6,722,440 B2 4/2004 Turner et al.
6,725,934 B2 4/2004 Coronado et al.
6,752,212 B2 6/2004 Burris et al.
6,763,885 B2 7/2004 Cavender
6,782,948 B2 8/2004 Echols et al.
6,820,697 B1 11/2004 Churchill
6,883,610 B2 4/2005 Depiak
6,907,936 B2 6/2005 Fehr et al.
6,951,331 B2 10/2005 Haughom et al.
7,021,384 B2 4/2006 Themig
7,066,265 B2 6/2006 Surjaatmadja et al.
7,096,954 B2 8/2006 Weng

(56) References Cited

U.S. PATENT DOCUMENTS

| | | | |
|---|---|---|---|
| 7,108,060 | B2 | 9/2006 | Jones |
| 7,108,067 | B2 | 9/2006 | Themig et al. |
| 7,134,505 | B2 | 11/2006 | Fehr et al. |
| 7,152,678 | B2 | 12/2006 | Turner et al. |
| 7,198,110 | B2 | 4/2007 | Kilgore et al. |
| 7,231,987 | B2 | 6/2007 | Kilgore et al. |
| 7,240,733 | B2 | 7/2007 | Hayes et al. |
| 7,243,723 | B2 | 7/2007 | Surjaatmadja et al. |
| 7,267,172 | B2 | 9/2007 | Hofman |
| 7,353,878 | B2 | 4/2008 | Themig |
| 7,377,321 | B2 | 5/2008 | Rytlewski |
| 7,431,091 | B2 | 10/2008 | Themig et al. |
| 7,543,634 | B2 | 6/2009 | Fehr et al. |
| 7,571,765 | B2 | 8/2009 | Themig |
| 7,748,460 | B2 | 7/2010 | Themig et al. |
| 7,832,472 | B2 | 11/2010 | Themig |
| 7,861,774 | B2 | 1/2011 | Fehr et al. |
| 8,167,047 | B2 | 5/2012 | Themig et al. |
| 8,215,411 | B2 | 7/2012 | Flores et al. |
| 8,276,675 | B2 | 10/2012 | Williamson et al. |
| 8,281,866 | B2 | 10/2012 | Tessier et al. |
| 8,291,980 | B2 | 10/2012 | Fay |
| 8,393,392 | B2 | 3/2013 | Mytopher et al. |
| 8,397,820 | B2 | 3/2013 | Fehr et al. |
| 8,490,685 | B2 | 7/2013 | Tolman et al. |
| 8,657,009 | B2 | 2/2014 | Themig et al. |
| 8,714,272 | B2 | 5/2014 | Garcia et al. |
| 8,746,343 | B2 | 6/2014 | Fehr et al. |
| 8,757,273 | B2 | 6/2014 | Themig et al. |
| 8,978,773 | B2 | 3/2015 | Tilley |
| 8,997,849 | B2 | 4/2015 | Lea-Wilson et al. |
| 9,074,451 | B2 | 7/2015 | Themig et al. |
| 9,121,264 | B2 | 9/2015 | Tokarek |
| 9,303,501 | B2 | 4/2016 | Fehr et al. |
| 2001/0009189 | A1 | 7/2001 | Brooks et al. |
| 2001/0015275 | A1 | 8/2001 | van Petegem et al. |
| 2001/0018977 | A1 | 9/2001 | Kilgore |
| 2001/0050170 | A1 | 12/2001 | Woie et al. |
| 2002/0007949 | A1 | 1/2002 | Tolman et al. |
| 2002/0020535 | A1 | 2/2002 | Johnson et al. |
| 2002/0096328 | A1 | 7/2002 | Echols et al. |
| 2002/0112857 | A1 | 8/2002 | Ohmer et al. |
| 2002/0117301 | A1 | 8/2002 | Womble |
| 2002/0162660 | A1 | 11/2002 | Depiak et al. |
| 2003/0127227 | A1 | 7/2003 | Fehr et al. |
| 2004/0000406 | A1 | 1/2004 | Allamon et al. |
| 2004/0055752 | A1 | 3/2004 | Restarick et al. |
| 2005/0061508 | A1 | 3/2005 | Surjaatmadja |
| 2006/0048950 | A1 | 3/2006 | Dybevik et al. |
| 2007/0119598 | A1 | 5/2007 | Turner et al. |
| 2007/0151734 | A1 | 7/2007 | Fehr et al. |
| 2007/0272411 | A1 | 11/2007 | Lopez De Cardenas et al. |
| 2007/0272413 | A1 | 11/2007 | Rytlewski et al. |
| 2008/0017373 | A1 | 1/2008 | Jones et al. |
| 2008/0223587 | A1 | 9/2008 | Cherewyk |
| 2009/0084553 | A1 | 4/2009 | Rytlewski et al. |
| 2010/0132959 | A1 | 6/2010 | Tinker |
| 2011/0127047 | A1 | 6/2011 | Themig et al. |
| 2011/0180274 | A1 | 7/2011 | Wang et al. |
| 2012/0067583 | A1 | 3/2012 | Zimmerman et al. |
| 2012/0085548 | A1 | 4/2012 | Fleckenstein et al. |
| 2013/0014953 | A1 | 1/2013 | van Petegem |
| 2013/0043042 | A1 | 2/2013 | Flores et al. |
| 2014/0096970 | A1 | 4/2014 | Andrew et al. |
| 2014/0116731 | A1 | 5/2014 | Themig et al. |
| 2014/0290944 | A1 | 10/2014 | Kristoffer |
| 2016/0069157 | A1 | 3/2016 | Themig et al. |

FOREIGN PATENT DOCUMENTS

| | | | |
|---|---|---|---|
| EP | 0094170 | A2 | 11/1983 |
| EP | 0724065 | A2 | 7/1996 |
| EP | 0802303 | A1 | 4/1997 |
| EP | 0823538 | A2 | 2/1998 |
| EP | 0950794 | A2 | 10/1999 |
| EP | 0985797 | A2 | 3/2000 |
| EP | 0985799 | A2 | 3/2000 |
| GB | 2311315 | A | 9/1997 |
| WO | WO 97/36089 | A1 | 10/1997 |
| WO | WO 01/06086 | A1 | 1/2001 |
| WO | WO 01/69036 | A1 | 9/2001 |
| WO | WO 2007/017353 | A1 | 2/2007 |
| WO | WO 2009/132462 | A1 | 11/2009 |

OTHER PUBLICATIONS

238th District Court, Midland, Texas, Case No. CV44964, Exhibit 11, Email from William Sloane Muscroft to Peter Krabben dated Jan. 11, Email from William Sloane Muscroft to Peter Krabben dated Jan. 27, 2000, 1 page.

238th District Court, Midland, Texas, Case No. CV44964, Exhibit 12, Email from William Sloane Muscroft to Daniel Jon Themig dated Feb. 1, 2000, 1 page.

238th District Court, Midland, Texas, Case No. CV44964, Exhibit 13, Email from Daniel Jon Themig to William Sloane Muscroft dated Jun. 19, 2000, 2 pages.

238th District Court, Midland, Texas, Case No. CV44964, Exhibit 6, Deposition of Daniel Jon Themig, Calgary, Alberta, Canada, dated Jan. 17, 2006, parts 1 and 2 total for a total of 82 pages with redactions from p. 336, Line 10 through all of p. 337.

238th District Court, Midland, Texas, Case No. CV44964, Exhibit 7, Deposition of Daniel Jon Themig, Calgary, Alberta, Canada, dated Jan. 8, 2007, 75 pages with redactions from p. 716, Line 23 through p. 726, Line 22.

238th District Court, Midland, Texas, Case No. CV44964, Exhibit 8, Deposition of Daniel Jon Themig, Calgary, Alberta, Canada, dated Jan. 9, 2007,46 pages with redactions on p. 850, Lines 13-19.

238th District Court, Midland, Texas, Case No. CV44964, Exhibit 9, Cross-examination of Daniel Jon Themig, In the Court of Queen's Bench of Alberta, Canada, dated Mar. 14, 2005, 67 pages.

A.B. Yost et al., "Production and Stimulation Analysis of Multiple Hydraulic Fracturing of a 2,000-ft Horizontal Well," SPE-19090, 14 pages, dated 1989.

A.P. Bunger et al., "Experimental Investigation of the Interaction Among Closely Spaced Hydraulic Fractures," <https://www.onepetro.org/conference-paper/ARMA-11-318?sort=&start=0&q=review+AND+%22packers%22+AND+%22uncased+%22&from_year=2001&peer_reviewed=&published_between=on&fromSearchResults=true&to_year=&rows=50#>, ARMA-11-318, 11 pages, dated 2011.

Alfred M. Jackson et al., "Completion and Stimulation Challenges and Solutions for Extended-Reach Multizone Horizontal Wells in Carbonate Formations," <https://www.onepetro.org/conference-paper/SPE-141812-MS?sort=&start=0&q=uncased+packer&from_year=2001&peer_reviewed=&published_between=on&fromSearchResults=true&to_year=&rows=50#>, SPE-141812-MS, 11 pages, dated 2011.

Anderson, Svend Aage, et al., "Exploiting Reservoirs with Horizontal Wells: the Maersk Experience," Oilfield Review, vol. 2, No. 3, Jul. 11-21, 1990.

Angeles, et al., "One Year of Just-In-Time Perforating as Multi-Stage Fracturing Technique for Horizontal Wells," Society of Petroleum Engineers, SPE 160034, 2012; 12 pages.

Arguijo, et al., "Streamlined Completions Process: An Eagle Ford Shale Case History," Society of Petroleum Engineers, SPE 162658, 2012; 17 pages.

B.W. McDaniel et al., " Overview of Stimulation Technology for Horizontal Completions without Cemented Casing in the Lateral," SPCE-77825, pp. 1-17, dated 2002.

Backer Packers, Flow Control Systems, 2 pages, 1982-83.

Baihly, Jason, et al, "Sleeve Activation in Open-hole Fracturing Systems: A Ball Selection Study", Oct. 30-Nov. 1, 2012 (SPE Canadian Unconventional Resources Conference; SPE 162657), pp. 1-14, 2012.

Baker CAC, A Baker Hughes company, 1990-91 Condensed Catalog, 1990-91, 8 pages.

Baker Hughes Baker Oil Tools, Packer Systems Product Catalog, 152 pages.

(56) References Cited

OTHER PUBLICATIONS

Baker Hughes, "Intelligent Well Systems™," bakerhughes.com, dated Jun. 7, 2001.
Baker Hughes, Baker Oil Tools, "Cased Hole Applications," 95 pages.
Baker Hughes, Baker Oil Tools, "Open Hole Completion Systems", 3 pages, 2004.
Baker Hughes, catalog, pp. 66-73, 1991.
Baker Hughes,"Re-entry Systems Technology," <http://www.bakerhughes.com/Bot/iws/index.htm>, Dated 1999.
Baker Oil Tools Press Release, "The Edge, Electronically Enhanced Remote Autuation System," dated Jun. 10, 1996.
Baker Oil Tools product advertisements allegedly from 1948-1969, 70 pages.
Baker Oil Tools Product Announcements, "Baker Oil Tools' HCM Remote Controlled Hydraulic Sliding Sleeve,"<http://www.bakerhughes.com/Bot/Pressroom/hcm.htm>, Dated Aug. 16, 2000.
Baker Oil Tools, "Baker Oil ToolsRegion/Area Locations," 2 pages.
Baker Oil Tools, "Packer Systems", 78 pages, undated.
Baker Oil Tools, "Plugging Devices", Model 'E'™ Hydro-Trip Sub, undated, 1 page.
Baker Oil Tools, "Retrievable Packer Systems, Model 'E'™ Hydro-Trip Pressure Sub—Product No. 799-28", undated, 1 page.
Baker Oil Tools, "Retrievable Packer Systems," product brochure, 1 page, undated.
Baker Oil Tools, "Retrievable Packer Systems," product catalog, 60 pages.
Baker Oil Tools, catalog, p. 29, Model "C" Packing Element Circulating Washer, Product No. 470-42, Mar. 1997.
Baker Oil Tools, catalog, p. 38, Twin Seal Submersible Pumppacker, undated.
Baker Oil Tools, Inc., "Technical Manual: Stage Cementing Equipment—Models "J" & "JB" Stage Cementing Collars" Aug. 1, 1966, 14 pages.
Baker Oil Tools, Inflatable Systems, pp. 1-50, undated, 50 pages.
Baker Oil Tools, Inflatable Systems, pp. 1-66, undated, 66 pages.
Baker Oil Tools, New Product Fact Sheet Retrievable Packer Systems, Model "PC" Hydraulic Isolation Packer Product No. 784-07, Jun. 1988, 2 pages.
Baker Oil Tools, Packer Systems Press Release, "Edge™ Remote Actuation System Successfully Sets Packer in Deepwater Gulf of Mexico," dated Jun. 10, 1996, modified Apr. 1998.
Baker Oil Tools' Archived Product Catalogs, 963 pages.
Baker Packers Flow Control Equipment, Bulletin No. BFC-1-6/83, 142 pages.
Baker Packers, "Seating Nipples" and "Accessories for Sliding Sleeves", pp. 13, 32-33, 99, 104-107, 110, 111, 114-115, undated.
Baker Packers, "Tool Identification by Model Number" and "Accessories for Selective and Top No-Go Seating Nipples", 4 pages.
Baker Sand Control, Open Hole Gravel Packing, undated, 1 page.
Baker Service Tools, Catalog: Lynes Inflatable Products, 5 pages, undated.
Baker Service Tools, Washing Tools, 1 pages, undated.
Berryman, William, First Supplemental Expert Report in Cause No. CV-44964, 238th Judicial District of Texas, undated.
Bill Ellsworth et al., "Production Control of Horizontal Wells in a Carbonate Reef Structure," 1999 CIM Horizontal Well Conference, 10 pages.
Billy W. McDaniel "Review of Current Fracture Stimulation Techniques for Best Economics in Multi-layer, Lower Permeability Reservoirs," <https://www.onepetro.org/conference-paper/SPE-98025-MS?sort=&start=0&q=review+horizontal+open+hole+%28uncased%29+completions+AND+%22multistage%22&from_year=2001&peer_reviewed=&published_between=on&fromSearchResults=true&to_year=2005&rows=50>, SPE-98025-MS, 19 pages, dated 2005.
BJ Services, Excape Completion Process, 12 pages,undated.
Brazil Oil & Gas, Norway Oil & Gas, 2009—Issue 10 Saudi Arabia Oil and Gas, 100 pages.
Brown Hughes, Hughes Production Tools General Catalog 1986-87, Brown Type PD 5000 Perforation Washer, 1986-87.
Brown Oil Tools General Catalog 1962-63, Hydraulic Set Packers and Hydraulic Set Retrievable Packers, pp. 870-871.
Brown Oil Tools, 1970-71 General Catalog, 3 pages, 1970-71.
Brown Oil Tools, catalog page, entitled "Brown HS-16-1 Hydraulic Set Retrievable Packers," undated.
Brown Oil Tools, catalog page, entitled "Brown Hydraulic Set Packers," undated.
Brown Oil Tools, Inc., "Brown Hydraulic Set Packers" 2 pages, undated.
Brown Oil Tools, Inc., Open Hole Packer—Long Lasting Dependability for Difficult Liner Cementing Jobs, 2 pages, undated.
Brown Oil Tools, Open Hole Packers—Long Lasting Dependability for Difficult Cementing Jobs, 1 page, undated.
"Brown Type Open Hole Packer", Brown 1986-1987 Catalog, 1 page.
C.D. Pope, et al., "Completion Techniques for Horizontal Wells in the Pearsall Austin Chalk," SPE Production Engineering, pp. 144-148, May 1992 (SPE 20682).
Canadian Sections SPE/Petroleum Society, 8th One-Day Conference on Horizontal Well Technology Schedule, Nov. 2001, 3 pages.
Canadian Sections SPE/Petroleum Society, 8th One-Day Conference on Horizontal Well Technology, Abstract: Open Hole Stimulation and Testing Carbonate Reservoirs, Nov. 2001, 1 page.
Canadian Sections SPE/Petroleum Society, 8th One-Day Conference on Horizontal Well Technology, Abstract: Successfule Open Hole Water Shut-Offs in Deep Hot Horizontal Wells, Nov. 2001, 1 page.
Canadian Sections SPE/Petroleum Society, 8th One-Day Conference on Horizontal Well Technology, Online Library Catalog Listing, Nov. 2001, 2 pages.
Canning, et al., "Innovative Pressure-Actuated Toe Sleeve Enables True Casing Pressure Integrity Test and Stage Fracturing While Improving Completion Economics in Unconventional Resources," Society of Petroleum Engineers, SPE 167170, 2013; 7 pages.
Carpenter, C., "Technology Applications," Journal of Petroleum Technology, accessible at http://www.spe.org/jpt/article/8570-technology-applications-33/, undated; 13 pages.
Chambers, M.R., et al, "Well Completion Design and Operations for a Deep Horizontal Well with Multiple Fractures", 1995 (SPE 30417), pp. 499-505.
Chauffe, S., "Hydraulic to Valve Specifically Designed for a Cemented Environment," AADE-13-FTCE-25, American Association of Drilling Engineers, 2013; 5 pages.
Composite Catalog of Oil Field Equipment and Services, Lynes Cement Collar, p. 18, 1980-81, 2 pages.
Composite Catalog of Oil Field Equipment Services, Baker Sand Control, Open Hole Gravel Packing, p. 870, 1980-81, 2 pages.
Conn, et al, "A Common Sense Approach to Intelligent Completions Through Improved Reliability and Lower Costs", Technical Publication, PROMORE 002, Nov. 2001, 7 pages.
Conn, T., "The Need for Intelligent Completions in Land-Based Well", PROMORE Engineering Inc, 2001, 8 pages.
Conn, Tim, "Get Smart, New Monitoring System Improves Understanding of Reservoirs", New Technology Magazine, Jan./Feb. 2001.
Coon, Robert et al., "Single-Trip Completion Concept Replaces Multiple Packers and Sliding Sleeves in Selection Multi-Zone Production and Stimulation Operations," Society of Petroleum Engineers, SPE-29539, pp. 911-915, dated 1995.
Crawford, M., "Fracturing Gas-Bearing Strata," Well Servicing Magazine, Nov.-Dec. 2009; 3 pages.
D.L. Purvis et al., "Alternative Method for Stimulating Open Hole Horizontal Wellbores," SPE-55614, pp. 1-13, dated 1999.
D.W. Thomson et al., "Design and Installation of a Cost-Effective Completion System for Horizontal Chalk Wells Where Multiple Zones Require Acid Stimulation," Offshore Technology Conference, OTC 8472, pp. 323-335, dated May 1997.
D.W. Thomson et al., "Design and Installation of a Cost-Effective Completion System for Horizontal Chalk Wells Where Multiple Zones Require Acid Stimulation," Society of Petroleum Engineers, SPE 37482, pp. 97-108, dated 1997.
D.W. Thomson et al., "Design and Installation of a Cost-Effective Completion System for Horizontal Chalk Wells Where Multiple

(56) References Cited

OTHER PUBLICATIONS

Zones Require Acid Stimulation," SPE Drilling & Completion, SPE 51177, pp. 151-156, Sep. 1998, disclosed at SPE Production Operations Symposium, Mar. 9-11, 1997, Oklahoma City, Oklahoma.
Damgaard, A.P. et al., "A Unique Method for Perforating, Fracturing, and Completing Horizontal Wells," SPE Production Engineering, Feb. 1992, (SPE-19282), pp. 61-69.
Daniel Savulescu, "Inflatable Casing Packers—Expanding the limits," Journal of Canadian Petroleum Technology, vol. 36, No. 9, pp. 9-10, dated Oct. 1997.
Defendants' Invalidity Contentions, *Rapid Completions LLC* v. *Baker Hughes Incorporated, et al*., v. *Packers Plus Energy Services, Inc., et al*., Case No. 6:15-cv-00724-RWS-KNM (E.D. Texas); 84 pages.
Denney, D., "Technology Applications," Journal of Petroleum Technology, accessible at http://www.spe.org/jpt/article/198-technology-applications-2012-04/, Apr. 2012; 10 pages.
Denney, D., "Technology Applications," Journal of Petroleum Technology, accessible at http://www.spe.org/jpt/m/article/450-technology-applications-august-2012, Aug. 2012; 4 pages.
Donald S. Dreesen et al., "Developing Hot Dry Rock Reservoirs with Inflatable Open Hole Packers," LA-UR-87-2083, 9 pages, dated 1987.
Donald S. Dreesen et al., "Open Hole Packer for High Pressure Service in a Five Hundred Degree Fahrenheit Precambrian Wellbore," LA-UR-85-42332, SPE-14745, 14 pages, dated 1985.
Doug G. Durst et al. "Advanced Open Hole Multilaterals," <https://www.onepetro.org/conference-paper/SPE-77199-MS?sort=&start=0&q=review+AND+%22packers%22+AND+%22open+hole%22&from_year=2001&peer_reviewed=&published_between=on&fromSearchResults=true&to_year=&rows=50#>, SPE-77199-MS, pp. 1-8, dated 2002.
Drawings, Packer Installation Plan, PACK 05543, 5 pages, 1997.
Dresser Oil Tools, catalog, Multilateral Completion Tools Section, undated.
Dresser Oil Tools, catalog, Technical Section, title page and p. 18, Nov. 1997.
Dresser Oil Tools, Multilateral and Horizontal Completions—Zonemaster Reservoir Access Mandrels, "The Zonemaster Reservoir Access Mandrel offers a long term performance alternative to the use of sliding sleeves in Horizontal wells." undated, 2 pages.
European Search Report, European Appl. No. 10836870.5, EPO, 11 pages, mailed Nov. 21, 2015.
Exxon Mobil, "Tight Gas: New Technologies, New Solutions," ExxonMobil, May 2010; 2 pages.
F.M. Verga et al., "Advanced Well Simulation in a Multilayered Reservoir," <https://www.onepetro.org/conference-paper/SPE-68821-MS?sort=&start=250&q=review+horizontal+open+hole+%28uncased%29+completions+AND+%22multi%22&from_year=&peer_reviewed=&published_between=on&fromSearchResults=true&to_year=2001&rows=50#>, SPE-68821-MS, 10 pages, dated 2001.
Federal Court of Calgary, Alberta Canada, Court File No. T-1202-13, Further Amended Statement of Defence and Counterclaim to Amended Statement of Claim, dated May 13, 2014, 24 pages.
Federal Court of Calgary, Alberta Canada, Court File No. T-1728-15, Statement of Defence and Counterclaim to Amended Statement of Claim, dated Feb. 1, 2016, 24 pages.
Federal Court of Toronto, Ontario Canada, Court File No. T-1202-13, Fresh as Amended Counterclaim of TMK Completions Ltd. and Perelam, LLC., dated Jul. 13, 2015, 15 pages.
Federal Court of Toronto, Ontario Canada, Court File No. T-1741-13, Statement of Defence and Counterclaim, dated Nov. 22, 2013, 11 pages.
First Supplemental Expert Report of Kevin Trahan, Case No. CV-44,964, 238th Judicial District, Midland County, Texas, Aug. 21, 2008, 28 pages.
Fishing Services, Baker Oil Tools, 2001 Catalog.
Fishing Services, Baker Oil Tools, undated catalog.
Garfield, et al., "Novel Completion Technology Eliminates Formation Damage and Reduces Rig Time in Sand Control Applications," Society of Petroleum Engineers, SPE 93518, 2005; 5 pages.
George Everette King, "60 Years of Multi-Fractured Vertical, Deviated and Horizontal Wells: What Have We Learned?," <https://www.onepetro.org/conference-paper/SPE-170952-MS?sort=&start=100&q=review+AND+%22packers%22+AND+%22open+hole%22&from_year=2014&peer_reviewed=&published_between=on&fromSearchResults=true&to_year=&rows=100#>, SPE-170952-MS, 32 pages, dated 2014.
Guiberson Ava—Dresser Oil Tools, "Technical Section—Advanced Horizontal and Multilateral Completions", Nov. 1997, 36 pages.
Guiberson Ava & Dresser, Retrievable Packer Systems, "Tandem Packer (Wizard I)", p. 32, undated.
Guiberson Ava & Dresser, "Hydraulic Set Packer: G-77 Packer," p. 20, undated.
Guiberson Ava, Dresser Oil Tools, "Tech Manual: Wizard II Hydraulic Set Retrievable Packer,"Apr. 1998, 42 pages.
Guiberson Ava, Packer Installation Plan, 5 pages, Nov. 11, 1997.
Guiberson Ava, Packer Installation Plan, Aug. 26, 1997.
Guiberson Ava, Packer Installation Plan, Sep. 9, 1997.
Guiberson Ava, Wizard II Hydraulic Set Retrievable Packer Tech Manual, Apr. 1998.
Guiberson-Ava Dresser, catalog, front page and pp. 1 & 20, 1994.
Halliburton "Halliburton Guiberson® G-77 Hydraulic-Set Retrievable Packer," 6 pages, undated.
Halliburton Oilwell Cementing Company, Fracturing Services, 1956 catalog, 6 pages.
Halliburton Oilwell Cementing Company, Improved Services for Increasing Production, 1956 catalog, 3 pages.
Halliburton Retrievable Service Tools, product brochure, 15 pages, undated.
Halliburton Services, 1970-71 Sales and Service Catalog, pp. 2335, 2338, 2340, and 2341, 6 pages.
Halliburton Services, 1970-71 Sales and Service Catalog, pp. 2434-2435, 3 pages.
Halliburton, Plaintiffs Fourth Amended Petition in Cause No. CV-44964, 238th Judicial District of Texas, Aug. 13, 2007.
Halliburton, catalog, pp. 51-54, 1957.
Halliburton, "Casing Sales Manual: Multiple-Stage Fracturing," Jul. 2003, 10 pages.
Halliburton, "Full-Opening (FO) Multiple-Stage Cementer," p. 12, 2001, 2 pages.
Halliburton, "Hydraulic-Set Guiberson™ Wizard Packer®," 1 page, undated.
Halliburton, "Unlock the Trapped Potential of Your High Perm Reservoir," <http://www.halliburton.com/products/prod_enhan/f-3335.htm> halliburton.com, dated Feb. 26, 2000.
Halliburton, "Zonemaster Reservoir Access Mandrel System", undated.
Halliburton, Completion Products, p. 2-25, 1999 3 pages.
Halliburton, Multiple-Stage Fracturing, pp. 9-1 and 9-2, 2013.
Hansen, J. H. et al., "Controlled Acid Jet (CAJ) Technique for Effective Single Operation Stimulation of 14,000+ ft Long Reservoir Sections," Society of Petroleum Engineers Inc., SPE 78318, Oct. 2002, 11 pages.
Henderson, R., "Open Hole Completion Systems," Presentation, Kentucky Oil & Gas Association, 2014; 33 pages.
Henry Restarick, "Horizontal Completion Options in Reservoirs with Sand Problems," SPE-29831, pp. 545-560, dated 1995.
Hodges, Steven, et al, "Hydraulically-Actuated Intelligent Completions: Development and Applications", (OTC-11933-MS) May 2000, 16 pages.
Horizontal Completion Problems, Baker Hughes Solutions, 1996, 6 pages.
I.B. Ishak et al., "Review of Horizontal Drilling", <https://www.onepetro.org/conference-paper/SPE-29812-MS?sort=&start=0&q=review+horizontal+open+hole+%28uncased%29+completions+AND+%22multi%22&from_year=&peer_reviewed=&published_between=on&fromSearchResults=true&to_year=2001&rows=50#>, SPE-29812-MS, pp. 391-404, dated 1995.
Ismail Gamal et al., "Ten Years Experience in Horizontal Application & Pushing The Limits of Well Construction Approach in Upper Zakum Field (Offshore Abu Dhabi) ," <https://www.onepetro.org/

(56) References Cited

OTHER PUBLICATIONS conference-paper/SPE-87284-MS?sort=&start=150 &q=review+horizontal+open+hole+%28uncased%29+ completions+AND+%22multi%22&from_year=&peer_reviewed= &published_between=on&fromSearchResults=true&to_year=2001 &rows=50#>, SPE-87284-MS, 17 pages, dated 2000.
J.C. Zimmerman et al., "Selection of Tools for Stimulation in Horizontal Cased Hole," SPE-18995, 12 pages, dated 1989.
J.E. Brown et al., "An Analysis of Hydraulically Fractured Horizontal Wells," SPE-24322, dated 1992.
Jesse J. Constantine, "Selective Production of Horizontal Openhole Completions Using ECP and Sliding Sleeve Technology," SPE-55618, pp. 1-5, dated 1999.
John B. Weirich et al., "Frac-Packing: Best Practices and Lessons Learned from over 600 Operations," <https://www.onepetro.org/ conference-paper/SPE-147419-MS?sort=&start=0 &q=%22packers%22+AND+%22open+hole%22+AND+ %22review%22+AND+%22advanced%22&from_year=2010 &peer_reviewed=&published_between=on &fromSearchResults=true&to_year=&rows=100#>, SPE-147419-MS, 17 pages, dated 2012.
John H. Healy et al., "Hydraulic Fracturing in Situ Stress Measurements to 2.1 KM Depth at Cajon Pass, California," Geophysical Research Letters, vol. 15, No. 9, pp. 1005-1008, dated 1988.
Johnny Bardsen et al. "Improved Zonal Isolation in Open Hole Applications," <https://www.onepetro.org/conference-paper/SPE-169190-MS?sort=&start=0 &q=review+and+%22packers%22+AND+%22open+hole%22 &from_year=2001&peer_reviewed=&published_between=on &fromSearchResults=true&to_year=&rows=50#>, SPE-169190-MS, 10 pages, dated 2014.
Jul. 23, 2008 Declaration of Daniel J. Themig, U.S. Appl. No. 12/058,337, filed Aug. 1, 2008.
Kamphuis, H., et al, "Multiple Fracture Stimulations in Horizontal Open-Hole Wells The Example of Well Boetersen Z9," Germany, 1998 (SPE 50609), pp. 351-360.
Kogsball, Hans-Henrik, et al., Ceramic screens control proppant flowback in fracture-stimulated offshore wells, Aug. 2011, pp. 43-50.
Koloy, et al., "The Evolution, Optimization & Experience of Multistage Frac Completions in a North Sea Environment," Society of Petroleum Engineers, SPE-170641-MS, 2014; 15 pages.
Koshtorev, pp. 14-15, 1987, 2 pages.
Lagone, K.W. et al., SPE-530-PA—"A New Development in Completion Methods—The Limited Entry Technique," Shell Oil Co., Jul. 1963, pp. 695-702.
Larsen, Frank P., et al., "Using 4000 ft Long Induced Fractures to Water Flood the Dan Field," Sep. 1997 (SPE 38558), pp. 583-593.
Leonard John Kalfayan, "The Art and Practice of Acid Placement and Diversion: History, Present State, and Future, " <https://www.onepetro.org/conference-paper/SPE-124141-MS?sort=&start=0 &q=%22horizontal+chalk+wells%22+AND+%22review%22+ &from_year=&peer_reviewed=&published_between= &fromSearchResults=true&to_year=&rows=50#>, 124141-MS SPE Conference Paper, pp. 1-17, dated 2009.
Lohoefer, et al., "New Barnett Shale Horizontal Completion Lowers Cost and Improves Efficiency," Society of Petroleum Engineers, SPE 103046, 2006; 9 pages.
Lynes ECPs and Cementing Tools, Baker catalog, pp. 89 and 87, dated 1988, 5 pages.
M.C. Vincent, "Proving It—A Review of 80 Published Field Studies Demonstrating the Importance of Increased Fracture Conductivity", <https://www.onepetro.org/conference-paper/SPE-77675-MS?sort=&start=0&q=horizontal+open+hole+uncased+ completions+AND+%22multistage%22&from_year=2001&peer_ reviewed=&published_between=on&fromSearchResults=true &to_year=2005&rows=50#>, SPE-77675-MS, pp. 1-21, dated 2002.
M.R. Norris et al., "Hydraulic Fracturing for Reservoir Management: Production Enhancement, Scale Control and Asphaltine Prevention," <https://www.onepetro.org/conference-paper/SPE-71655-MS?sort=&start=350&q=review+horizontal+open+ hole+%28uncased%29+completions+AND+%22multi%22 &from_year=&peer_reviewed=&published_between=on &fromSearchResults=true&to_year=2001&rows=50#>, SPE-71655-MS, 12 pp., dated 2001.
Maddox, et al., "Cementless Multi-Zone Horizontal Completion Yields Three-Fold Increase," IADC/SPE Drilling Conference, IADC/SPE 112774, 2008; 7 pages.
Martin P. Coronado et al., "Advanced Openhole Completions Utilizing a Simplified Zone Isolation System," SPE 77438, pp. 1-11, Dated 2002.
Martin P. Coronado et al., "Development of a One-trip ECP Cement Inflation and Stage Cementing System for Open Hole Completions," IADC/SPE-39345, pp. 473-481, dated 1998.
Martin, A.N., "Innovative Acid Fracturing Operations Used to Successfully Simulate Central North Sea Reservoir," SPE 36620, pp. 479-486, dated 1996.
Mascara, S., et al, "Acidizing Deep Open-Hole Horizontal Wells: A case History on Selective Stimulation and Coil Tubing Deployed Jetting System," 1999 (SPE 54738) 11 pages.
Mathur, et al., "Contrast Between Plug and Perf Method and Ball and Sleeve Method for Horizontal Well Stimulation," Sep. 14, 2013; 12 pages.
Mazerov, Katie, "Innovative Systems Enhance Ability to Achieve Selective Isolated Production in Horizontal Wells", Drilling Contractor, May/Jun. 2008, pp. 124-129.
McDaniel, B.W., et al, "Limited-Entry Frac Applications on Long Intervals of Highly Deviated or Horizontal Wells", 1999, pp. 1-12 (SPE 56780).
Mitchell, et al., "First Successful Application of Horizontal Open Hole Multistage Completion Systems in Turkey's Selmo Field," Society of Petroleum Engineers, SPE-17077-MS, 2014; 9 pages.
Morali, Shirali C., An Innovative Single-Completion Design With Y-Block and ESP for Multiple Reservoirs, May 1990 (SPE-17663-PA) pp. 113-119.
Neftyanoe, Hozyaistvo, p. 42, 1993, 1 page.
Neftyanoe, Hozyaistvo, pp. 40-41, 1993, 2 pages.
Offshore Magazine "One Trip Completion Method," dated Jul. 2001.
Olivier Lietard et al., "Hydraulic Fracturing of Horizontal Wells: An Update of Design and Execution Guidelines," <https://www.onepetro.org/conference-paper/SPE-37122-MS?sort=&start=0 &q=review+horizontal+open+hole+%28uncased%29+ completions+AND+%22multistage%22&from_year=&peer_ reviewed=&published_between=on&fromSearchResults=true &to_year=2001&rows=50#>, SPE-37122-MS, pp. 723-737, dated 1996.
Order of Dismissal, Case No. CV-44,964, 238th Judicial District, Midland County, Texas, Oct. 14, 2008, 1 page.
Osisanya S. et al., "Design Criteria and Selection of Downhole Tools for Conducting Interference Tests in Horizontal Wells" SPE/CIM/CANMET International Conference on Recent Advances in Horizontal Well Applications, Mar. 20-23, 1994, Calgary, Canada, Paper No. HWC-94-58.
Otis Pumpdown Equipment and Services, OTIS Pumpdown Flow Control Equipment, Production Maintenance Utilizing Pumpdown Tools, OTIS Pumpdown Completion Equipment, 1974-75 Catalog.
Owen Oil Tools Mechanical Gun Release; 2-3/8" & 2-7/8" product description, 1 page, undated.
P. D. Ellis et al., "Application of Hydraulic Fractures in Openhole Horizontal Wells," SPE-65464, 10 pages, dated 2000.
Packer Plus, *New Technology RockSeal Open Hole Packer Series*, not dated, 1 page.
Packers Plus, Second Amended Original Answer in Cause No. CV-44964, 238th Judicial District of Texas, Feb. 13, 2007.
Packers Plus—New Technology, "RockSeal Open Hole Packers Series", Dec. 21, 2005.
Packers Plus Energy Services Homepage, "Welcome to Packers Plus," <http://packersplus.com/index.htm>, dated Feb. 23, 2000.
Packers Plus Energy Services, Inc. "5.1 RockSeal™ II Open Hole Packer Series," <http://www.packersplus.com/rockseal%202.htm>, 2 pgs., dated 2004, available prior to Nov. 19, 2001.
Packers Plus Press Release, "Ken Paltzat Canadian Operations Manager for Packers Plus," Dated Feb. 1, 2000.
Packers Plus, Original Answer in Cause No. CV-44964, 238th Judicial District of Texas, Feb. 13, 2007.

(56) References Cited

OTHER PUBLICATIONS

Paolo Gavioli et al., "The Evolution of the Role of Openhole Packers in Advanced Horizontal Completions: From Optional Accessory to Critical Key of Success," <https://www.onepetro.org/conference-paper/SPE-132846-MS?sort=&start=0&q=%22packers%22+and+%22open+hole%22+AND+%22review%22+AND+%22advanced%22&from_year=2010&peer_reviewed=&published_between=on&fromSearchResults=true&to_year=&rows=100#>, SPE-132846-PA, pp. 1-27, dated 2010.
PetroQuip Energy Services, BigFoot PetroQuip Case Study, Dec. 22, 2015; 1 page.
PetroQuip Energy Services, BigFoot Production Description, accessible at http://www.petroquip.com/index.php/2012-10-22-19-46-41/land-completions/big-foot, undated; 2 pages.
PetroQuip Energy Services, BigFoot Toe Sleeve PetroQuip Case Study, Nov. 2014; 2 pages.
Petro-Tech Tools, Inc., Dump Circulating Sub, Jul. 2, 1996, 3 pages.
Polar Completions Engineering Inc. Technical Manual, Jul. 5, 2001, Rev. 2, 13 pages.
Polar Completions Engineering, Bearfoot Packer 652-0000, 5 pages, Jul. 5, 2001.
R. Seale et al. "An Effective Horizontal Well Completion and Stimulation System, "Journal of Canadian Petroleum Technology, vol. 46, No. 12, pp. 73-77, dated Dec. 2007.
R.J. Tailby et al., "A New Technique for Servicing Horizontal Wells," SPE-22823, pp. 43-58, Dated 1991.
Ricky Plauche and W. E. (Skip) Koshak, "Advances in Sliding Sleeve Technology and Coiled Tubing Performance Enhance Multizone Completion of Abnormally Pressured Gulf of Mexico Horizontal Well," ICoTA, Apr. 1997 (SPE 38403).
Rockey Seale et al., "Effective Simulation of Horizontal Wells—A New Completion Method," SPE-106357, 5 pages, dated 2006.
Ross, Elsie, "New Monitoring System Improves Understanding of Reservoirs", New Tech Magazine, Jan. 2001.
Rune Freyer, "Swelling Packer for Zonal Isolation in Open Hole Screen Completions," SPE-78312, pp. 1-5, dated 2002.
Ryan Henderson, "Open Hole Completion Systems," Tennessee Oil and Gas Association, dated 2014.
S. Mascarà, et al., "Acidizing Deep Open-Hole Horizontal Wells: A case History on Selective Stimulation and Coil Tubing Deployed Jetting System," SPE-54738, pp. 1-11, dated 1999.
Sapex Oil Tools Ltd. Downhole Completions catalog, 24 pages, undated.
Seale, Rocky, "Open-Hole completions System Enables Multi-Stage Fracturing and Stimulation Along Horizontal Wellbores", Drilling Contractor, Jul./Aug. 2007, pp. 112-114.
Suresh Jacob et al. "Advanced Well Completion Designs to Meet Unique Reservoir and Production Requirements," <https://www.onepetro.org/conference-paper/SPE-172215-MS?sort=&start=0&q=review+AND+%22packers%22+AND+%22open+hole%22&from_year=2014&peer_reviewed=&published_between=on&fromSearchResults=true&to_year=&rows=100#>, SPE-172215-MS, pp. 1-13, dated 2014.
T.P. Frick "State-Of-The-Art in The Matrix Stimulation of Horizontal Wells," <https://www.onepetro.org/journal-paper/SPE-26997-PA?sort=&start=0&q=horizontal+open+hole+uncased+completions+AND+%22multistage%22&from_year=&peer_reviewed=&published_between=on&fromSearchResults=true&to_year=2001&rows=50#>, SPE-26997-PA, pp. 94-102, dated May 1996.
Tam Inflatable Zone Insolation Systems, TAM catalog, p. 5, 1 page.
Tam International, "Inflatable Bridge Plugs and Cement Retainers,"<http://tamintl.com/pages/plugg.htm>, Dated Oct. 22, 2000.
Tam Int'l Inc., TAM Casing Annulus Packers and Accessories, pp. 14-15, 1994, 4 pages.
Tam Int'l Inc., TAM Casing Annulus Packers and Accessories, pp. 4-5, 1994, 4 pages.
Team Oil, "Multi-Stage Fracturing—Orio Toe Valve," TEAM Oil Tools, accessible at http://www.teamoiltools.com/ProductServices/Multistage-Fracturing-ORIO-Toe-Valve/, undated; 1 page.
Thomas Finkbeiner, "Reservoir Optimized Fracturing—Higher Productivity From Low—Permeability Reservoirs Through Customized Multistage Fracturing," Society of Petroleum Engineers, SPE—141371, pp. 1-16, dated 2011.
Top Tool Company, Hydraulic Perforation Wash Tool, 4 pages, undated.
Trahan, Kevin, Affidavit Exhibit C, May 19, 2008.
Trahan, Kevin, Affidavit Exhibit E, May 19, 2008.
Trahan, Kevin, Affidavit Exhibit G, May 19, 2008.
Trahan, Kevin, Affidavit, May 19, 2008.
Van Domelen, M.S., "Enhanced Profitability with Non-Conventional IOR Technology," Oct. 1998 (SPE 49523), pp. 599-609.
White, Cameron, "Formation Characteristics dictate Completion Design", Oil & Gas Journal, pp. 31-36, 1991.
Wong, F.Y. et al., "Developing a Field Strategy to Eliminate Crossflow Along a Horizontal Well," SPE/CIM/CANMET International Conference on Recent Advances in Horizontal Well Applications, Mar. 20-23, 1994, Calgary, Canada, Paper No. HWC-94-24.
Yakovenko, et al, "Tests Results of the New Device for Open Bottom Hole Wells Cementing Operations," May 2001, 3 pages.
Yuan, et al., "Improved Efficiency of Multi-Stage Fracturing Operations: An Innovative Pressure Activated Toe Sleeve," Society of Petroleum Engineers, SPE-172971-MS, 2015; 6 pages.
Yuan, et al., "Unlimited Multistage Frac Completion System: A Revolutionary Ball-Activated System with Single Size Balls," Society of Petroleum Engineers, SPE 166303, 2013; 9 pages.
A.B. Yost, "Air Drilling and Multiple Hydraulic Fracturing of a 72 Slant Well in Devonian Shale," SPE 21264, 1990.
A.B. Yost, "Hydraulic Fracturing of a Horizontal Well in a Naturally Fractured Reservoir: Gas Study for Multiple Fracture Design," SPE 17759, 1988.
A.W. Layne, "Insights Into Hydraulic Fracturing of a Horizontal Well in a Naturally Fractured Formation," SPE 18255, 1988.
Abass, H.H. , A Case History of Completing and Fracture Stimulating a Horizontal Well, SPE 29443, Apr. 2, 1995.
Affidavit of Aileen Barr of Halliburton Energy Services, Inc., regarding Halliburton Completion Products, Second Edition (1997) with attachments, dated Jul. 21, 2016.
Affidavit of Aileen Barr of Halliburton Energy Services, Inc., regarding Halliburton Completion Products, Second Edition (1997), dated Mar. 30, 2017.
Affidavit of Debbie Caples regarding Kate Van Dyke, Fundamentals of Petroleum Engineering (4th ed. 1997) and Ron Baker, a Primer of Oil Well Drilling (5th ed. (rev.) 1996), dated Sep. 30, 2016.
Affidavit of Margaret Kieckhefer, of the Library of Congress, regarding excerpts from Composite Catalog of Oil Field and Pipe Line Equipment, vol. 2 (21st ed. World Oil 1955), Jun. 20, 2016.
Affidavit of Nancy Chaffin Hunter regarding the proceedings of the 10th Middle East Oil Show & Conference (Bahrain Mar. 15-18, 1997) (including D.W. Thomson, et al., Design and Installation of a Cost- Effective Completion System for Horizontal Chalk Wells Where Multiple Zones Require Acid Stimulation, spe (Society for Petroleum Engineering) 37482 (1997), Jul. 28, 2016.
Affidavit of Nancy Chaffin Hunter, regarding the proceedings of the Production Operation Symposium (Oklahoma City, OK Apr. 2-4, 1995) (including R. Coon and D. Murray, Single-Trip Completion Concept Replaces Multiple Packers and Sliding Sleeves in Selective Multi-Zone Production and Stimulation Operations, SPE 29539 (1995)), Jul. 28, 2016.
Affidavit of Roberto Pellegrino regarding publication of the Seventh One Day Conference on Horizontal Well Technology, Nov. 3, 1999, undated.
Ahmadzamri, A.F., "Development and Testing of Advanced Wireline Conveyance Technology for Rugose Open Hole Conditions" IPTC 17442 (2014).
Ali Daneshy, Ph.D. Declaration for U.S. Pat. No. 7,134,505, dated Feb. 12, 2016 (IPR2016-00596).
Ali Daneshy, Ph.D. Declaration for U.S. Pat. No. 7,134,505, dated Jul. 29, 2016 (IPR2016-01505).
Ali Daneshy, Ph.D. Declaration for U.S. Pat. No. 7,134,505, dated Mar. 4, 2016 (IPR2016-00596).
Ali Daneshy, Ph.D. Declaration for U.S. Pat. No. 7,543,634, dated Feb. 19, 2016 (IPR2016-00597).
Ali Daneshy, Ph.D. Declaration for U.S. Pat. No. 7,861,774, dated Feb. 19, 2016 (IPR2016-00598).

(56) References Cited

OTHER PUBLICATIONS

Ali Daneshy, Ph.D. Declaration for U.S. Pat. No. 7,861,774, dated Jul. 29, 2016 (IPR2016-01506).
Ali Daneshy, Ph.D. Declaration for U.S. Pat. No. 8,657,009, dated Feb. 25, 2016 (IPR2016-00656).
Ali Daneshy, Ph.D. Declaration for U.S. Pat. No. 9,074,451, dated Feb. 25, 2016 (IPR2016-00657).
Ali Daneshy, Ph.D. Declaration for U.S. Pat. No. 9,303,501, dated Nov. 11, 2016 (IPR2017-00247).
Ali Daneshy, Ph.D. Declaration for U.S. Pat. No. 9,303,501, dated Sep. 2, 2016 (IPR2016-01380).
Ali Daneshy, Ph.D. Deposition Transcript, dated Mar. 29, 2017.
Ali Daneshy, Ph.D. Deposition Transcript, dated Nov. 9, 2016.
Ali Daneshy, Ph.D. Second Declaration for U.S. Pat. Nos. 7,134,505; 7,543,634; 7,861,774; 8,657,009; and 9,074,451, dated Mar. 8, 2017 (IPR2016-00656).
Austin et al., Simultaneous Multiple Entry Hydraulic Fracture Treatments of Horizontally Drilled Wells, SPE 18263 (1988).
Baker Hughes, 10-K Shareholder Report (2008).
Baker Hughes, 10-K Shareholder Report (2010).
Baker Hughes, 10-K Shareholder Report (2013).
Baker Hughes, Design Documents, Engineering Change Notice, dated Dec. 23, 2004.
Baker Hughes, Automatic YouTube Captions of FracPoint Openhole Fracture Completion System Video, https://www.youtube.com/watch?v=s5ZQCRRZzXE, Oct. 21, 2010.
Baker Hughes, Letter brief regarding Motion for Summary Judgment of Indefiniteness, dated Sep. 20, 2016.
Baker Hughes, "Enhancing Well Performance Through Innovative Completion Technologies" Presentation, dated Sep. 10-12, 2012.
Baker Hughes, "FracPoint Completion System Isolated Openhole Horizontal Well in Lower Huron Shale" (2011).
Baker Hughes' and Peak Completions' Subpoena to Halliburton, dated Mar. 11, 2016.
Bradley W. Caldwell Declaration, dated May 10, 2017 (IPR2017-01236).
Britt, L. and Smith, M., Horizontal Well Completion, Stimulation Optimization, and Risk Mitigation, SPE 125526 (2009).
Calgary Herald, "Innovation—Groundbreaking Innovation in Calgary," dated Feb. 12, 1014.
Calixto, Eduardo, "Gas and Oil Reliability Engineering, Modeling and Analysis," 2nd Edition (2016).
Canadian Society for Unconventional Resources, Press Release, "Unconventional Industry Awards Innovative Thinking," dated Oct. 3, 2012.
Carl T. Montgomery, Hydraulic Fracturing—History of an Enduring Technology (2010).
Carrie Anderson Declaration for IPR2016-01509, dated Jul. 28, 2016.
Carrie Anderson Declamtion for IPR2016-01514, dated Mar. 21, 2017.
Casero, et al., "Open Hole Multi-Stage Completion System in Unconventional Plays: Efficiency, Effectiveness and Economics," SPE 1640009 (2013).
Christopher D. Hawkes Declaration regarding the proceedings of the 7th One-Day Conference On Horizontal Well Technology Operational Excellence (Canada Nov. 3, 1999), dated Sep. 21, 2016 (IPR2017-00247).
Christopher D. Hawkes Declaration regarding the proceedings of the 7th One-Day Conference On Horizontal Well Technology Operational Excellence (Canada Nov. 3, 1999), dated Feb. 19, 2016 (IPR2016-00656).
Complaint, *Rapid Completions LLC* v. *Baker Hughes, et al.*, filed Jul. 31, 2015.
Default Protective Order, undated.
Cramer, D.D., "The Application of Limited-Entry Techniques in Massive Hydraulic Fracturing Treatments," SPE 16189 (1987).
Cramer, David, "Stimulating Unconventional Reserviors: Lessons Learned, Successful Practices, Areas for Improvement," SPE 114172, (2008).
Crosby, D.G., "Methodology to Predict the Initiation of Multiple Transverse Fractures from Horizontal Wellbores," (2001).
D. Lohoefer, "Comparative Study of Cemented versus Uncemented Multi-Stage Fractured Wells in the Barnett Shale," SPE 135386 (2010).
Defendants' (Weatherford) Invalidity Contentions cover document, served Jan. 19, 2016.
Defendants' (Weatherford) Second Amended Invalidity Contentions, served Aug. 11, 2016.
Defendants' (Weatherford.) amended invalidity contention metadata, dated Aug. 11,.
Defendants' (Weatherford.) initial invalidity contention metadata, dated Jan. 19, 2016.
Webster's Third New International Dictionary of the English Language Unabridged, dictionary definitions: "p. 1724: 'Pisote' through 'Pitch' and p. 2141: 'Sleepy Hollow Chair' through 'Slick'," (1986).
Webster's Third New International Dictionary of the English Language Unabridged, dictionary definitions: "p. 22: 'Activated Alumina' through 'Acushla', p. 751: 'Enemy Alien' through 'Engelmannia', and pp. 1574-1575: 'Omicron' through 'One'," (1986).
McGraw-Hill Dictionary of Scientific and Technical Terms, dictionary definitions: "p. 30: 'Active Substrate' through 'Acuate'," 5th ed. (1989).
*American Heritage Dictionary*, dictionary definitions: "p. 610, 'Enfeeble' through 'English'," 3rd ed. (1992).
*Webster's II New Riverside Dictionay*, dictionary definitions: "pp. 525 and 526, 'Plebeian' through 'Ply'," Revised Office ed. (1996).
Email correspondence between M. Garrett and J. Nemunaitis, dated Sep. 28, 2016 through Oct. 3, 2016.
Email from Green to Nemunaitis, dated Jul. 11, 2016.
Email from J. Nemunaitis to Payne, dated Sep. 19, 2016.
Email from J. Nemunaitis with Attachment: RC's First Set of RFAs to WFD.PDF (Rapid Completion's First Set of Requests for Admissions to Weatherford), dated Dec. 9, 2016.
Emanuele, M. A., "A Case History: Completion and Stimulation of Horizontal Wells with Multiple Transverse Hydraulic Fractures in the Lost Hills Diatomite," SPE 39941 (1998).
Encyclopedia of Hydrocarbons, Chapter 3.1: Upstream technologies, (2007).
Excerpt from Feb. 16, 2017 transcript of Canadian Litigation.
Exploration and Development, Alberta Oil Magazine, undated.
Feng Yuan, "Single-Size-Ball Interventionless Multi-Stage Stimulation System Improves Stimulated Reservoir Volume and Eliminates Milling Requireents: Case Studies," SPE171183-MS (2014).
Financial Post, "Entrepreneur of the Year: National Winner," dated Dec. 2009.
Gaynor, T., "Tortuosity Versus Micro-Tortuosity—Why Little Things Mean a Lot," SPE/IADC 67818 (2001).
H. McGowen Declaration for U.S. Pat. No. 8,657,009, dated Dec. 2, 2016 (IPR2016-00656).
H. McGowen Declaration Redacted for U.S. Pat. No. 7,861,774, dated Dec. 2, 2016 (IPR2016-00650).
H. McGowen Supplemental Expert Report for U.S. Pat. Nos. 7,861,774; 7,134,505; 7,543,634: and 9,303,501, dated May 31, 2017.
H. McGowen, Deposition Transcript of Feb. 28, 2017.
Halliburton, Completion Products, Second Edition (1997).
*Halliburton* v. *Packers Plus*, Fourth Amended Petition, dated Aug. 13, 2007.
Hart Petroleum, vol. 71, No. 6, Jun. 1998.
Howard, G. C. & Fast, C. R., Hydraulic Fracturing, AIMMPE (1970).
Hyne, Norman J., Dictionary of Petroleum Exploration, Drilling, & Production (1991).
Ingersoll, C., "BP and the Deepwater Horizon Disaster of 2010", (Apr. 3, 2012).
J. Chury, "Packers Plus Technology Becoming the Industry Standard, The Oil Patch Report," (Dec. 2010/Jan. 2011).
J. J. Giraldi Declaration Redacted for IPR2016-00597, dated Dec. 2, 2016.
Letter and Written Interrogatories propounded by plaintiffs in *Rapid Completions LLC, et al.* v. *Baker Hughes Canada Co.*, Federal

(56) References Cited

OTHER PUBLICATIONS

Court File No. T-1569-15) (Ottawa), regarding Canadian patent No. CA 2,412,072, dated Jan. 19, 2017.
Letter and Responses to Jan. 19, 2017 Letter and Written Interrogatories propounded by plaintiffs in *Rapid Completions LLC, et al.* v. *Baker Hughes Canada Co.*, Federal Court File No. T-1569-15) (Ottawa), regarding Canadian patent No. CA 2,412,072, dated Jan. 30, 2017.
Justin T. Nemunaitis Declaration for IPR2017-01236, dated May 10, 2017.
Kaiser, P., "Hydraulic Fracturing Mine Back Trials—Design Rationale and Project Status," (2013).
Kevin Trahan Affidavit, dated May 19, 2008 with Exhibits A-J, 63 pages.
Kevin Trahan Expert Report Redacted, dated Apr. 27, 2007, 12 pages.
Canadian OilPatch Technology Guidebook ,"Leading the Way: Multistage fracking pioneer Packers Plus plays major role in cracking the tight oil code," (2012).
Leah Burrati Deposition Transcript, dated May 18, 2016.
List of attorneys docket sheet from Case No. 6:15-cv-00724; *Rapid Completions* v. *Baker Hughes et al.*, Nov. 23, 2016.
Lloyd, B., "Rotary steerable drilling improves deployment of advanced completion," World Oil, (Jan. 2011).
M. Delaney Declaration for IPR2016-01380, dated May 31, 2017.
M. Delaney Declaration for IPR2016-01505, dated May 31, 2017.
M. Delaney Declaration for IPR2016-01509, dated May 31, 2017.
M. Delaney Declaration for IPR2016-01514 and IPR2016-01517, dated May 31, 2017.
M.Delaney Declaration for U.S. Pat. No. 7,134,505, dated Apr. 17, 2017 (IPR2016-00596).
M. Delaney Declaration for U.S. Pat. No. 7,134,505, dated Dec. 2, 2016 (IPR2016-00596).
M. Delaney Declaration for U.S. Pat. No. 7,134,505, dated Nov. 25, 2016 (IPR2016-01517).
M. Delaney Declaration for U.S. Pat. No. 7,543,634, dated Dec. 2, 2016 (IPR2016-00597).
M. Delaney Declaration for U.S. Pat. No. 7,543,634, dated Nov. 25, 2016 (IPR2016-01514).
M.Delaney Declaration for U.S. Pat. No. 7,861,774, dated Dec. 2, 2016 (IPR2016-00598).
M. Delaney Declaration for U.S. Pat. No. 7,861,774, dated Nov. 25, 2016 (IPR2016-01509).
M. Delaney Declaration for U.S. Pat. No. 9,303,501, dated Dec. 12, 2016 (IPR2016-01380).
M. Delaney Declaration for U.S. Pat. No. 9,303,501, dated Mar. 2, 2017 (IPR2017-00247).
M. Delaney Declaration for IPR2016-01496, dated May 31, 2017.
M.J. Rees, et al., "Successful Hydrajet Acid Squeeze and Multifracture Acid Treatments in Horizontal Open Holes Using Dynamic Diversion Process and Downhole Mixing," SPE 71692 (Sep. 30, 2001).
Email from Justin Nemunaitis, dated Mar. 1, 2017.
Murray et al., "A Case Study for Drilling and Completing a Horizontal Well in the Clinton Sandstone," SPE 37354 (1996).
Overbey et al., "Drilling, Completion, Stimulation, and Testing of Handy HW#1 Well, Putnam County, West Virginia, Final Report," DOE/MC/25115-3115 (1992) (indexed in Energy Research Abstracts, vol. 18, No. 3, ISSN:0160-3604 (Mar. 1993)).
Owens et al., "Practical Considerations of Horizontal Well Fracturing in the 'Danish Chalk,'" SPE25058 (1992).
P. Roche, "Open-Hole or Cased and Cemented," New Technology Magazine (Nov. 2011).
Packers Plus advertising brochure (2010).
Packers Plus Case Study, "StackFRAC HD system enables high stimulation rates," Nov. 30, 2016.
Packers Plus case study, "StackFRAC system provides superior production economics," May, 26 2015.
Packers Plus Declaration of Tess MacLeod for IPR2016-01505, dated May 31, 2017.
Packers Plus Design Document, undated.
Packers Plus Energy Services Inc, "Proven Performance: Read how Packers Plus systems and solutions have delivered results around the world," accessed May 24, 2016, http://packersplus.com/proven-performance/?type=case- study&system=stackfrac-hd-system &pag=3%20#p3.
Packers Plus, StackFRAC HD Ssystem, http://packersplus.com/solution/stackfrac-he-system/, undated.
Webster's Third New International Dictionary of the English Language Unabridged, p. 1794: 'Presentor through Press', (1986).
Patrick J. McLellan, et al., "A Multiple-Zone Acid Stimulation Treatment of a Horizontal Well," Midale, Saskatchewan, Apr. 1992 Journal of Canadian Petroleum Technology at 71-82, and 42nd Annual Technical Meeting.
R. Ghiselin, Qittitut Consulting, "Sleeves vs. Shots—The Debate Rages," (Aug. 2011).
R.E. Hurst, "Development and Application of 'Frac' Treatments in the Permian Basin," SPE 405 (1954).
Rapid Completions LLC Demonstrative Slides for IPR2016-00650, IPR00656, and IPR00657, submitted May 16, 2017.
Rapid Completions LLC Photograph Physical Demonstratives, submitted May 16, 2017.
Rapid Completions LLC's Infringement Contentions transmittal email, dated Nov. 23, 2015.
*Rapid Completions* v. *Baker Hughes et al.*, Order dismissing Pegasi, dated Sep. 23, 2016.
Rebekah Stacha Declaration regarding SPE 37482 for IPR2017-00247, dated Sep. 19, 2016.
Rebekah Stacha Declaration regarding SPE 49523 for IPR2017-00247, dated Sep. 19, 2016.
Rebekah Stacha Declaration regarding SPE 51177-PA for IPR2017-01236, dated Jul. 11, 2016.
Rigzone Training, How Does Acidizing Work to Stimulate Production?, http://www.rigzone.com/training/insight.asp?insight_id=320 (Apr. 25, 2017).
Rigzone, Schlumberger Acquires Stake in Packers Plus (Nov. 22, 2005).
Ron Baker, A Primer of Oil Well Drilling (5th ed. (revised) 1998).
Stoltz, L.R., "Probabilistic Reserves Assessment Using A Filtered Monte Carlo Method In a Fractured Limestone Reservoir," SPE 39714 (1998).
Supplemental Engineering Report Prepared by Ronald A. Britton, Aug. 20, 2008.
U.S. Appl. No. 09/690,767 (U.S. Pat. No. 6,435,282) File History, Appl. filed Oct. 17, 2000.
U.S. Appl. No. 09/837,097 (U.S. Pat. No. 6,644,411) File History, Appl. filed Apr. 18, 2001.
U.S. Appl. No. 10/299,004 (U.S. Pat. No. 6,907,936) File History, Appl. filed Nov. 19, 2002.
U.S. Appl. No. 10/604,807 (U.S. Pat. No. 7,108,067) File History, Appl. filed Aug. 19, 2003.
U.S. Appl. No. 11/104,467 (U.S. Pat. No. 7,134,505) File History, Appl. filed Apr. 13, 2005.
U.S. Appl. No. 11/403,957 (U.S. Pat. No. 7,431,091) File History, Appl. filed Apr. 14, 2006.
U.S. Appl. No. 11/550,863 (U.S. Pat. No. 7,543,634) File History, Appl. filed Oct. 19, 2006.
U.S. Appl. No. 12/208,463 (U.S. Pat. No. 7,748,460) File History, Appl. filed Sep. 11, 2008.
U.S. Appl. No. 12/471,174 (U.S. Pat. No. 7,861,774) File History, Appl. filed May 22, 2009.
U.S. Appl. No. 12/830,412 (U.S. Pat. No. 8,167,047) File History, Appl. filed Jul. 5, 2010.
U.S. Appl. No. 12/966,849 (U.S. Pat. No. 8,397,820) File History, Appl. filed Dec. 13, 2010.
U.S. Appl. No. 13/455,291 (U.S. Pat. No. 8,657,009) File History, Appl. filed Apr. 25, 2012.
U.S. Appl. No. 13/612,533 (U.S. Pat. No. 8,746,343) File History, Appl. filed Sep. 12, 2012.
U.S. Appl. No. 14/150,514 (U.S. Pat. No. 9,074,451) File History, Appl. filed Jan. 8, 2014.
U.S. Appl. No. 14/267,123 (U.S. Pat. No. 9,366,123) File History, Appl. filed May 1, 2014.

(56) References Cited

OTHER PUBLICATIONS

U.S. Appl. No. 14/928,980 (U.S. Pat. No. 9,303,501) File History, Appl. filed Oct. 30, 2015.
U.S. Pat. No. 7,861,774—Lane-Wells invalidity chart, served Aug. 11, 2016.
U.S. Pat. No. 7,861,774—Thomson invalidity contention chart, undated.
U.S. Pat. No. 7,861,774—Yost invalidity chart, served Aug. 11, 2016.
U.S. Appl. No. 60/331,491, filed Nov. 19, 2001.
U.S. Appl. No. 60/404,783, filed Aug. 21, 2002.
V. Rao & R. Rodriguez, "Accelerating Technology Acceptance: Hypotheses and Remedies for Risk-Averse Behavior in Technology Acceptance," SPE 98511 (2005).
V. Rao, "1984 and Beyond: The Advent of Horizontal Wells" JPT (Oct. 2007).
V. Rao Declaration for U.S. Pat. No. 7,134,505 (IPR2016-01509).
V. Rao Declaration for U.S. Pat. No. 7,543,634 (IPR2016-01514).
V. Rao Declaration for U.S. Pat. No. 7,861,774 (IPR2016-01509).
V. Rao Declaration for U.S. Pat. No. 9,303,501 (IPR2017-01236).
V. Rao Deposition Transcript, dated Apr. 27, 2017.
Weatherford letter brief regarding Motion for Summary Judgment of Indefiniteness, dated Sep. 20, 2016.
Weatherford presentation titled, Openhole Completion Systems, undated.
Weatherford's Expedited Motion to Stay Pending Inter Partes Review Proceedings in Civil Action No. 6:15-cv-724-RWS-KNM, filed Sep. 13, 2016.
Westin, Scott. Private Property, PwC. http://upfront.pwc.com/growth/326-private-property, dated Jan. 2, 2013.
William Diggons Declaration for IPR2016-01505, dated Apr. 4, 2017.
Yager, David, "Court Case Now On: It's Packers Plus Versus The World—Here's What's at Stake for Multi-stage Horizontal Completion Companies," EnergyNow Media (Feb. 23, 2017).
Affidavit of Velma J'Nette Davis-Nichols, regarding regarding excerpts from Composite Catalog of Oil Field and Pipe Line Equipment, vol. 2 (21st ed. World Oil 1955), dated Feb. 13, 2017.
Ali Daneshy, Ph.D. Declaration for U.S. Pat. Nos. 7,861,774 (IPR2016-01506) and 9,303,501 (IPR2016-01380), dated Aug. 17, 2017.
C.M. Kim & H.H. Abass, Hydraulic facture initiation from horizontal wellbores: Laboratory experiments, in Rock Mechanics As a Multidisciplinary Science: Proceedings of the 32nd US Symposium on Rock Mechanics, at 231-240 (Jean-Claude Roegiers ed., CRC Press 1991).
Petitioner's Reply to Patent Owner's Objections to Evidence and Petitioner's Supplementary Evidence Pursuant to 37 C.F.R. § 42.64(b)(2) in IPR2016-01509, dated Mar. 22, 2017.
Email from Jason Shapiro to Justin Nemunaitis dated May 9. 2017.
Errata Sheet for Transcript of Feb. 28, 2017 Deposition Testimony of Harold R. McGowen III.
H. McGowen, Deposition Transcript for U.S. Pat. No. 7,134,505 (IPR2016-01496), dated Jul. 27, 2017.
H. McGowen, Deposition Transcript for U.S. Pat. No. 7,861,774 (IPR2016-01509), dated Jul. 26, 2017.
Kenny Paltzat Declaration dated Apr. 18, 2017.
Richard S. Carden Declaration dated Aug. 8, 2017.
Vikram Rao Deposition for U.S. Pat. Nos. 7,134,505 (IPR2016-01517), 7,861,774 (IPR2016-01509), and 7,543,634 (IPR2016-01514) dated Sep. 7, 2017.
Vikram Rao Reply Declaration for U.S. Pat. No. 7,861,774, dated Aug. 16, 2017.
W.K. Overbey, et al., Inducing Multiple Hydraulic Fractures From a Horizontal Wellbore, SPE (Society for Petroleum Engineering) 18249 (1988).

* cited by examiner

DOWNHOLE SUB WITH HYDRAULICALLY ACTUABLE SLEEVE VALVE

CROSS REFERENCE TO RELATED APPLICATIONS

This application is a divisional application of U.S. application Ser. No. 12/914,731 filed Oct. 28, 2010 which is presently pending. U.S. application Ser. No. 12/914,731 is a continuation-in-part of PCT application no. PCT/CA2009/000599, filed Apr. 29, 2009, which is a continuation-in-part of U.S. application Ser. No. 12/405,185, filed Mar. 16, 2009.

U.S. application Ser. No. 12/914,731 and this application claim priority to US provisional application Ser. No. 61/287,150, filed Dec. 16, 2009 and also claim priority through the above-noted PCT application to US provisional application Ser. No. 61/048,797, filed Apr. 29, 2008.

BACKGROUND

In downhole tubular strings, hydraulic pressure may be used to actuate various components. For example, packers may be pressure set, sleeve valves may be provided that are hydraulically moveable to open ports.

Although hydraulically actuable components are useful, difficulties can arise when there is more than one hydraulically actuable component to be separately actuated. In a system including pressure set packers and sleeve valves for tubular ports, difficulties have occurred when attempting to open the sleeve valves after the packers have been set.

Also, difficulties have occurred in strings where it is desired to run in the string with all ports closed by hydraulically actuable sleeve valves and then to open the sleeves at a selected time. If one port opens first, it is difficult to continue to hold pressure to move the sleeves from the remaining ports.

SUMMARY

In accordance with a broad aspect of the present invention, there is provided a hydraulically actuable sleeve valve comprising: a tubular segment including a wall defining therein an inner bore; a port through the wall of the tubular segment; a sleeve supported by the tubular segment and installed to be axially moveable relative to the tubular segment from a first position covering the port to a second position and to a third position away from a covering position over the port, the sleeve including a first piston face open to tubing pressure and a second piston face open to annular pressure, such that a pressure differential can be set up between the first piston face and the second piston face to drive the sleeve toward a low pressure side from the first position into the second position with the sleeve continuing to cover the port; and a driver to move the sleeve from the second position into the third position, the driver being unable to move the sleeve until the pressure differential is substantially dissipated.

In accordance with another broad aspect of the present invention there is provided a method for opening a port through the wall of a ported sub, the method comprising: providing a sub with a port through its tubular side wall; providing a hydraulically actuable valve to cover the port, the valve being actuable to move away from a position covering the port to thereby open the port; increasing pressure within the sub to create a pressure differential across the valve to move the valve toward the low pressure side, while the port remains closed by the valve; thereafter, reducing pressure within the sub to reduce the pressure differential; and driving the valve to move it away from a position covering the port.

In accordance with another broad aspect of the present invention there is provided a wellbore tubing string assembly, comprising: a tubing string; and a first plurality of sleeve valves carried along the tubing string, each of the first plurality of sleeve valves capable of holding pressure when a tubing pressure within the tubing string is greater than an annular pressure about the tubing string and the first plurality of sleeve valves being driven to open at substantially the same time as the tubing pressure is substantially equalized with the annular pressure.

In accordance with another broad aspect of the present invention there is provided a method of accessing a hydrocarbon laden formation comprising: providing a plurality of fluid flow regulating mechanisms; constructing a tubing string wherein the plurality of fluid flow regulating mechanisms are grouped into a plurality of areas including a first area including one or more of the plurality of fluid flow regulating mechanisms and a second area including one or more of the plurality of fluid flow regulating mechanisms; placing the tubing string into a wellbore passing into the hydrocarbon laden formation; actuating substantially simultaneously all of the fluid flow regulating mechanisms comprising the first area to access the hydrocarbon laden formation along the first area; and actuating substantially simultaneously all of the fluid flow regulating mechanisms comprising the second area to access the hydrocarbon laden formation along the second area.

In accordance with another broad aspect, there is provided a sleeve valve sub comprising: a tubular segment including a wall defining therein an inner bore; a first port through the wall of the tubular segment; a second port through the wall of the tubular segment; and, a sleeve supported by the tubular segment and installed to be axially moveable relative to the tubular segment from a first position covering the first port to a second position away from a covering position over the first port, the sleeve covering second port in the first position and the second position, the sleeve including an inner facing surface defining a full bore diameter, an inner diameter constriction on the inner diameter of the sleeve having a diameter less than the full bore diameter; an outer facing surface, an indentation on the outer facing surface radially aligned with the inner diameter constriction, the indentation defined by a extension of the outer facing surface protruding inwardly of the full bore diameter, the indentation being positionable over the second port when the sleeve is in the second position such that the second port is openable to fluid flow therethrough by removal of the inner diameter constriction.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention.

Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

DETAILED DESCRIPTION OF VARIOUS EMBODIMENTS

Figure 1A:
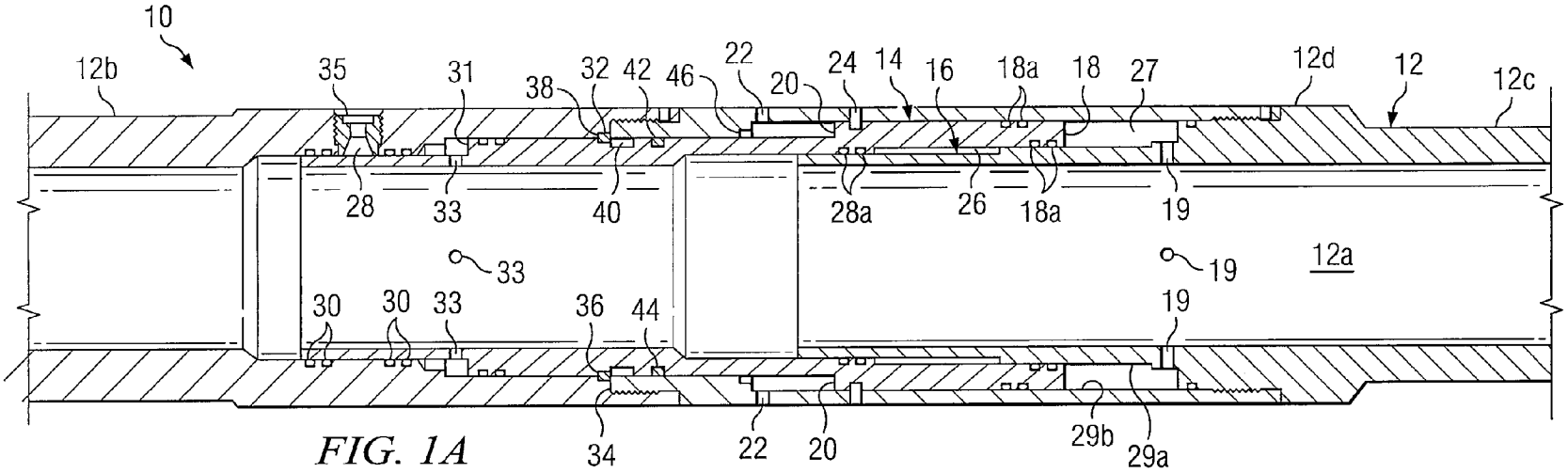
FIGS. 1A, 1B and 1C are axial sectional views of a sleeve valve in first, second and final positions, respectively, according to one aspect of the present invention.

The description that follows, and the embodiments described therein, is provided by way of illustration of an example, or examples, of particular embodiments of the principles of various aspects of the present invention. These examples are provided for the purposes of explanation, and not of limitation, of those principles and of the invention in its various aspects. In the description, similar parts are marked throughout the specification and the drawings with the same respective reference numerals. The drawings are not necessarily to scale and in some instances proportions may have been exaggerated in order more clearly to depict certain features.

Referring to the Figures, a hydraulically actuable sleeve valve 10 for a downhole tool is shown. Sleeve valve 10 may include a tubular segment 12, a sleeve 14 supported by the tubular segment and a driver, shown generally at reference number 16, to drive the sleeve to move.

Sleeve valve 10 may be intended for use in wellbore tool applications. For example, the sleeve valve may be employed in wellbore treatment applications. Tubular segment 12 may be a wellbore tubular such as of pipe, liner casing, etc. and may be a portion of a tubing string. Tubular segment 12 may include a bore 12*a* in communication with the inner bore of a tubing string such that pressures may be controlled therein and fluids may be communicated from surface therethrough, such as for wellbore treatment. Tubular segment 12 may be formed in various ways to be incorporated in a tubular string. For example, the tubular segment may be formed integral or connected by various means, such as threading, welding etc., with another portion of the tubular string. For example, ends 12*b*, 12*c* of the tubular segment, shown here as blanks, may be formed for engagement in sequence with adjacent tubulars in a string. For example, ends 12*b*, 12*c* may be formed as threaded pins or boxes to allow threaded engagement with adjacent tubulars.

Figure 1B:
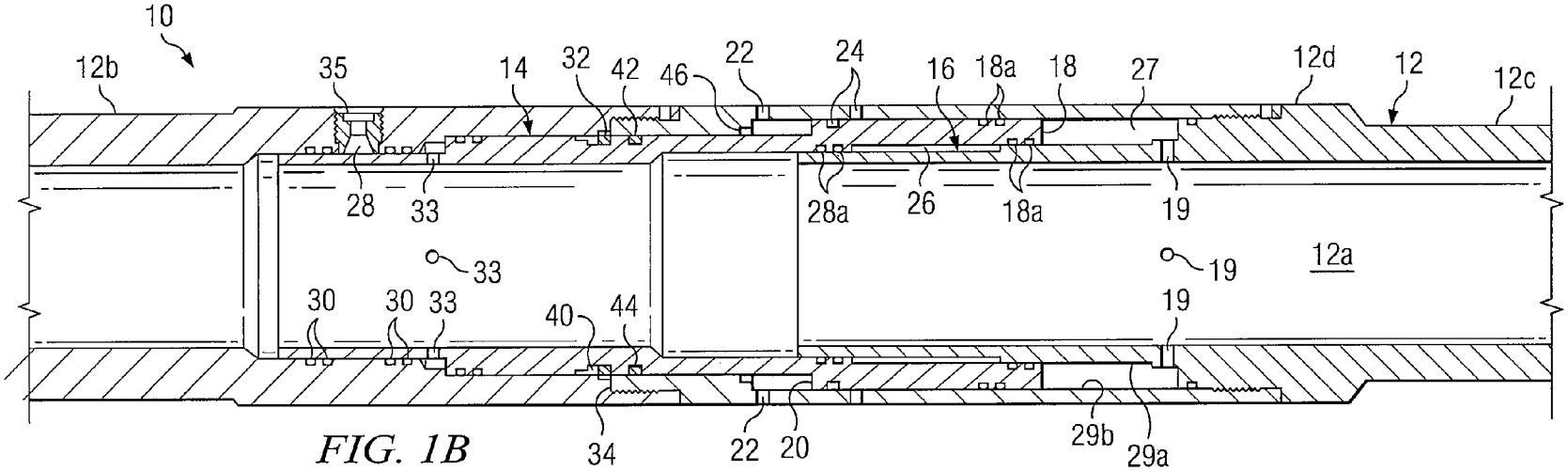
Figure 1C:
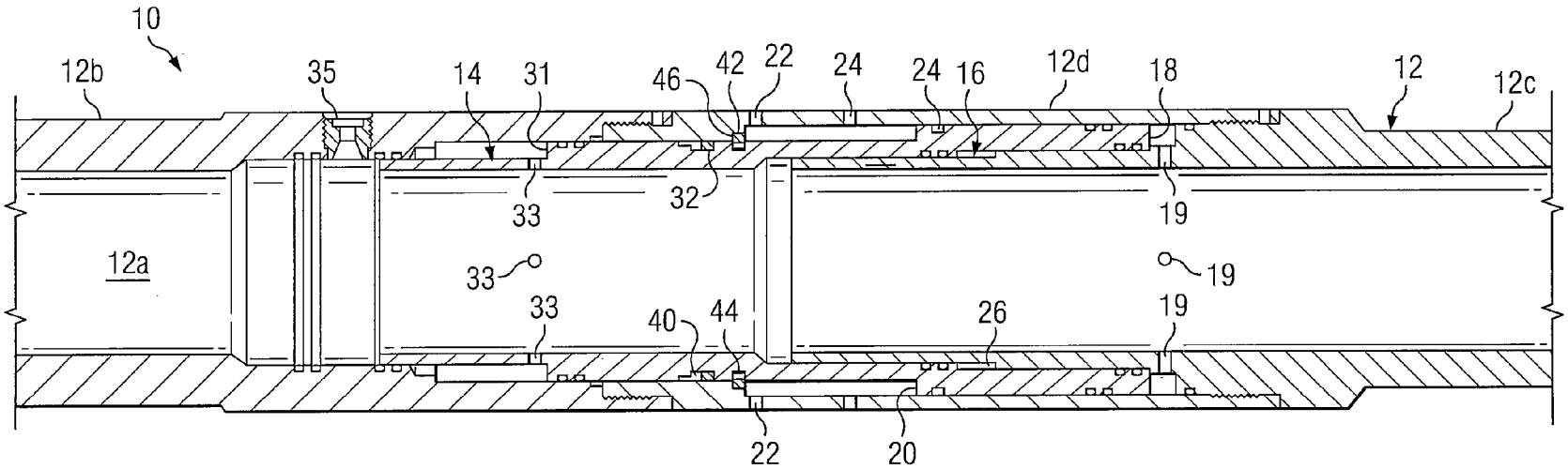

Sleeve 14 may be installed to act as a piston in the tubular segment, in other words to be axially moveable relative to the tubular segment at least some movement of which is driven by fluid pressure. Sleeve 14 may be axially moveable through a plurality of positions. For example, as presently illustrated, sleeve 14 may be moveable through a first position (FIG. 1A), a second position (FIG. 1B) and a final or third position (FIG. 1C). The installation site for the sleeve in the tubular segment is formed to allow for such movement.

Sleeve 14 may include a first piston face 18 in communication, for example through ports 19, with the inner bore 12*a* of the tubular segment such that first piston face 18 is open to tubing pressure. Sleeve 14 may further include a second piston face 20 in communication with the outer surface 12*d* of the tubular segment. For example, one or more ports 22 may be formed from outer surface 12*d* of the tubular segment such that second piston face 20 is open to annulus, hydrostatic pressure about the tubular segment. First piston face 18 and second piston face 20 are positioned to act oppositely on the sleeve. Since the first piston face is open to tubing pressure and the second piston face is open to annulus pressure, a pressure differential can be set up between the first piston face and the second piston face to move the sleeve by offsetting or adjusting one or the other of the tubing pressure or annulus pressure. In particular, although hydrostatic pressure may generally be equalized between the tubing inner bore and the annulus, by increasing tubing pressure, as by increasing pressure in bore 12*a* from surface, pressure acting against first piston face 18 may be greater than the pressure acting against second piston face 20, which may cause sleeve 14 to move toward the low pressure side, which is the side open to face 20, into a selected second position (FIG. 1B). Seals 18*a*, such as o-rings, may be provided to act against leakage of fluid from the bore to the annulus about the tubular segment such that fluid from inner bore 12*a* is communicated only to face 18 and not to face 20.

One or more releasable setting devices 24 may be provided to releasably hold the sleeve in the first position. Releasable setting devices 24, such as one or more of a shear pin (a plurality of shear pins are shown), a collet, a c-ring, etc. provide that the sleeve may be held in place against inadvertent movement out of any selected position, but may be released to move only when it is desirable to do so. In the illustrated embodiment, releasable setting devices 24 may be installed to maintain the sleeve in its first position but can be released, as shown sheared in FIGS. 1B and 1C, by differential pressure between faces 18 and 20 to allow movement of the sleeve. Selection of a releasable setting device, such as shear pins to be overcome by a pressure differential is well understood in the art. In the present embodiment, the differential pressure required to shear out the sleeve is affected by the hydrostatic pressure and the rating and number of shear pins.

Figure 2:
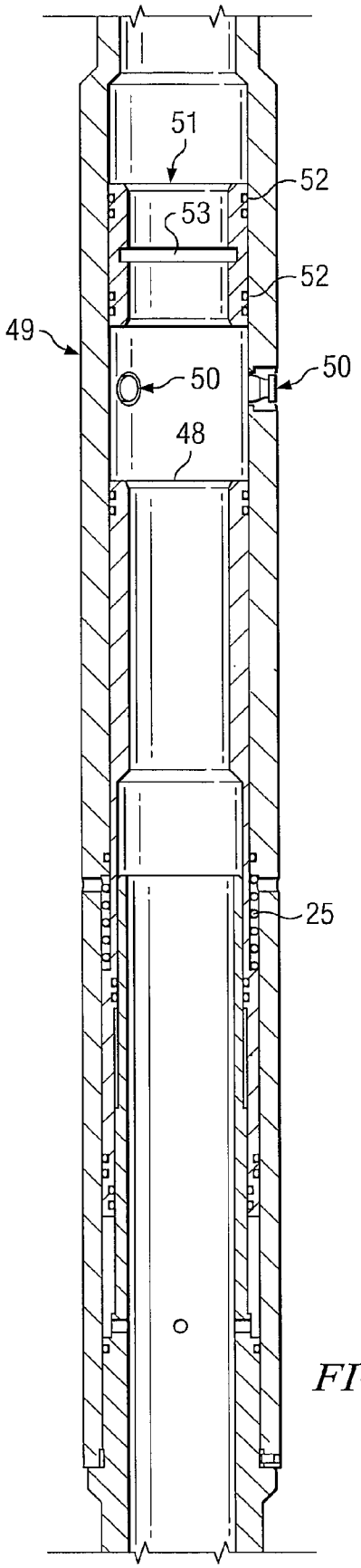
FIG. 2 is a sectional view through another sleeve valve tool useful in the present invention.

Driver 16 may be provided to move the sleeve into the final position. The driver may be selected to be unable to move the sleeve until releasable setting device 24 is released. Since driver 16 is unable to overcome the holding power of releasable setting devices 24, the driver can only move the sleeve once the releasable setting devices are released. Since driver 16 cannot overcome the holding pressure of releasable setting devices 24 but the differential pressure can overcome the holding force of devices 24, it will be appreciated then that driver 16 may apply a driving force less than the force exerted by the differential pressure such that driver 16 may also be unable to overcome or act against a differential pressure sufficient to overcome devices 24. Driver 16 may take various forms. For example, in one embodiment, driver 16 may include a spring 25 (FIG. 2) and/or a gas pressure chamber 26 (FIG. 1) to apply a push or pull force to the sleeve or to simply allow the sleeve to move in response to an applied force such as an inherent or applied pressure differential or gravity. In the illustrated embodiment of FIG. 1, driver 16 employs hydrostatic pressure through piston face 20 that acts against trapped gas chamber 26 defined between tubular segment 12 and sleeve 14. Chamber 26 is sealed by seals 18*a*, 28*a*, such as o-rings, such that any gas therein is trapped. Chamber 26 includes gas trapped at atmospheric or some other low pressure. Generally, chamber 26 includes air at surface atmospheric pressure, as may be present simply by assembly of the parts at surface. In any event, generally the pressure in chamber 26 is somewhat less than the hydrostatic pressure downhole. As such, when sleeve 14 is free to move, a pressure imbalance occurs across the sleeve at piston face 20 causing the sleeve to move toward the low pressure side, as provided by chamber 26, if no greater forces are acting against such movement.

In the illustrated embodiment, sleeve 14 moves axially in a first direction when moving from the first position to the second position and reverses to move axially in a direction opposite to the first direction when it moves from the second position to the third position. In the illustrated embodiment, sleeve 14 passes through the first position on its way to the third position. The illustrated sleeve configuration and sequence of movement allows the sleeve to continue to hold pressure in the first position and the second position. When driven by tubing pressure to move from the first position into the second position, the sleeve moves from one overlapping, sealing position over port 28 into a further overlapping, port closed position and not towards opening of the port. As such, as long as tubing pressure is held or increased, the sleeve will remain in a port closed position and the tubing string in which the valve is positioned will be capable of holding pressure. The second position may be considered a closed but activated or passive position, wherein the sleeve has been acted upon, but the valve remains closed. In the presently illustrated embodiment, the pressure differential between faces 18 and 20 caused by pressuring up in bore 12*c* does not move the sleeve into or even toward a port open position. Pressuring up the tubing string only releases the sleeve for later opening. Only when tubing pressure is dissipated to reduce or remove the pressure differential, can sleeve 14 move into the third, port open position.

While the above-described sleeve movement may provide certain benefits, of course other directions, traveling distances and sequences of movement may be employed depending on the configuration of the sleeve, piston chambers, releasable setting devices, driver, etc. In the illustrated embodiment, the first direction, when moving from the first position to the second position, may be towards surface and the reverse direction may be downhole.

Sleeve 14 may be installed in various ways on or in the tubular segment and may take various forms, while being axially moveable along a length of the tubular segment. For example, as illustrated, sleeve 14 may be installed in an annular opening 27 defined between an inner wall 29*a* and an outer wall 29*b* of the tubular segment. In the illustrated embodiment, piston face 18 is positioned at an end of the sleeve in annular opening 27, with pressure communication through ports 19 passing through inner wall 29*a*. Also in this illustrated embodiment, chamber 26 is defined between sleeve 14 and inner wall 29*a*. Also shown in this embodiment but again variable as desired, an opposite end of sleeve 14 extends out from annular opening 27 to have a surface in direct communication with inner bore 12*a*. Sleeve 14 may include one or more stepped portions 31 to adjust its inner diameter and thickness. Stepped portions 31, if desired, may alternately be selected to provide for piston face sizing and force selection. In the illustrated embodiment, for example, stepped portion 31 provides another piston face on the sleeve in communication with inner bore 12*a*, and therefore tubing pressure, through ports 33. The piston face of portion 31 acts with face 20 to counteract forces generated at piston face 18. In the illustrated embodiment, ports 33 also act to avoid a pressure lock condition at stepped portion 31. The face area provided by stepped portion 31 may be considered when calculating the total piston face area of the sleeve and the overall pressure effect thereon. For example, faces 18, 20 and 31 must all be considered with respect to pressure differentials acting across the sleeve and the effect of applied or inherent pressure conditions, such as applied tubing pressure, hydrostatic pressure acting as driver 16. Faces 18, 20 and 31 may all be considered to obtain a sleeve across which pressure differentials can be readily achieved.

In operation, sleeve 14 may be axially moved relative to tubular segment 12 between the three positions. For example, as shown in FIG. 1A, the sleeve valve may initially be in the first position with releasable setting devices 24 holding the sleeve in that position. To move the sleeve to the second position shown in FIG. 1B, pressure may be increased in bore 12*a*, which pressure is not communicated to the annulus, such that a pressure differential is created between face 18 and face 20 across the sleeve. This tends to force the sleeve toward the low pressure side, which is the side at face 20. Such force releases devices 24, for example shears the shear pins, such that sleeve 14 can move toward the end defining face 20 until it arrives at the second position (FIG. 1B). Thereafter, pressure in bore 12*a* can be allowed to relax such that the pressure differential is reduced or eliminated between faces 18 and 20. At this point, since the sleeve is free from the holding force of devices 24, once the pressure differential is sufficiently reduced, the force in driver 16 may be sufficient to move the sleeve into the third position (FIG. 1C). In the illustrated embodiment, for example, the hydrostatic pressure may act on face 20 and, relative to low pressure chamber 26, a pressure imbalance is established that may tend to drive sleeve 14 to the third, and in the illustrated embodiment of FIG. 1C, final position.

As such, a pressure increase within the tubular segment causes a pressure differential that releases the sleeve and renders the sleeve into a condition such that it can be acted upon by a driving force to move the sleeve to a further position. Pressuring up is only required to release the sleeve and not to move the sleeve into a port open position. In fact, since any pressure differential where the tubing pressure is greater than the annular pressure holds the sleeve in a port-closed, pressure holding position, the sleeve can only be acted upon by the driving force once the tubing pressure generated differential is dissipated. The sleeve may, therefore, be actuated by pressure cycling wherein a pressure increase within the tubular segment causes a pressure differential that releases the sleeve and renders the sleeve in a condition such that it can be acted upon by a driver, such as existing hydrostatic pressure, to move the sleeve to a further position.

The sleeve valve of the present invention may be useful in various applications where it is desired to move a sleeve through a plurality of positions, where it is desired to actuate a sleeve to open after increasing tubing pressure, where it is desired to open a port in a tubing string hydraulically but where the fluid pressure must be held in the tubing string for other purposes prior to opening the ports to equalize pressure and/or where it is desired to open a plurality of sleeve valves in the tubing string hydraulically at substantially the same time without a risk of certain of the valves failing to open due to pressure equalization through certain others of the valves that opened first. In the illustrated embodiment, for example, sleeve 14 in both the first and second positions is positioned to cover port 28 and seal it against fluid flow therethrough. However, in the third position, sleeve 14 has moved away from port and leaves it open, at least to some degree, for fluid flow therethrough. Although a tubing pressure increase releases the sleeve to move into the second position, the valve can still hold pressure in the second position and, in fact, tubing pressure creating a pressure differential across the sleeve actually holds the sleeve in a port closed position. Only when pressure is released after a pressure up condition, can the sleeve move to the port open position. Seals 30 may be provided to assist with the sealing properties of sleeve 14 relative to port 28. Such port 28 may open to an annular string component, such as a packer to be inflated, or may open bore 12*a* to the annular area about the tubular segment, such as may be required for wellbore treatment or production. In one embodiment, for example, the sleeve may be moved to open port 28 through the tubular segment such that fluids from the annulus, such as produced fluids can pass into bore 12*a*. Alternately, the port may be intended to allow fluids from bore 12*a* to pass into the annulus.

In the illustrated embodiment, for example, a plurality of ports 28 pass through the wall of tubular segment 12 for passage of fluids between bore 12*a* and outer surface 12*d* and, in particular, the annulus about the string. In the illustrated embodiment ports 28 each include a nozzle insert 35 for jetting fluids radially outwardly therethrough. Nozzle insert 35 may include a convergent type orifice, having a fluid opening that narrows from a wide diameter to a smaller diameter in the direction of the flow, which is outwardly from bore 12*a* to outer surface 12*d*. As such, nozzle insert 35 may be useful to generate a fluid jet with a high exit velocity passing through the port in which the insert is positioned. Alternately or in addition, ports 28 may have installed therein a choking device for regulating the rate or volume of flow therethrough, such as may be useful in limited entry systems. Port configurations may be selected and employed, as desired. For example, the ports may operate with or include screening devices. In another embodiment, the ports may communicate with inflow control device (ICD) channels such as those acting to create a pressure drop for incoming production fluids.

As illustrated, valve 10 may include one or more locks, as desired. For example, a lock may be provided to resist sleeve 14 of the valve from moving from the first position directly to the third position and/or a lock may be provided to resist the sleeve from moving from the third position back to the second position. In the illustrated embodiment, for example, an inwardly biased c-ring 32 is installed to act between a shoulder 34 on tubular member 12 and a shoulder 36 on sleeve 14. By acting between the shoulders, they cannot approach each other and, therefore, sleeve 14 cannot move from the first position directly toward the third position, even when shear pins 24 are no longer holding the sleeve. C-ring 32 does not resist movement of the sleeve from the first position to the second position. However, the c-ring may be held by another shoulder 38 on tubular member 12 against movement with the sleeve, such that when sleeve 14 moves from the first position to the second position the sleeve moves past the c-ring. Sleeve 14 includes a gland 40 that is positioned to pass under the c-ring as the sleeve moves and, when this occurs, c-ring 32, being biased inwardly, can drop into the gland. Gland 40 may be sized to accommodate the c-ring no more than flush with the outer diameter of the sleeve such that after dropping into gland 40, c-ring 32 may be carried with the sleeve without catching again on parts beyond the gland. As such, after c-ring 32 drops into the gland, it does not inhibit further movement of the sleeve.

Another lock may be provided, for example, in the illustrated embodiment to resist movement of the sleeve from the third position back to the second position. The lock may also employ a device such as a c-ring 42 with a biasing force to expand from a gland 44 in sleeve 14 to land against a shoulder 46 on tubular member 12, when the sleeve carries the c-ring to a position where it can expand. The gland for c-ring 42 and the shoulder may be positioned such that they align when the sleeve moves substantially into the third position. When c-ring 42 expands, it acts between one side of gland 44 and shoulder 46 to prevent the sleeve from moving from the third position back toward the second position.

The tool may be formed in various ways. As will be appreciated, it is common to form wellbore components in tubular, cylindrical form and oftentimes, of threadedly or weldedly connected subcomponents. For example, tubular segment in the illustrated embodiment is formed of a plurality of parts connected at threaded intervals. The threaded intervals may be selected to hold pressure, to form useful shoulders, etc., as desired.

Figure 18:
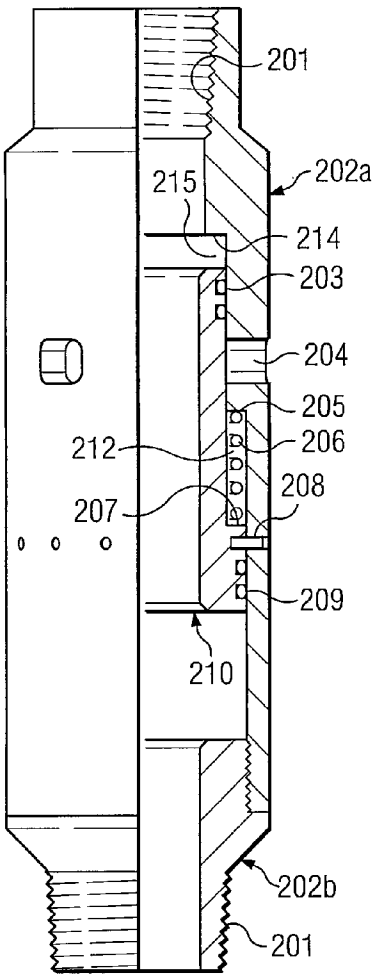
FIG. 18 is an axial sectional view of another sleeve valve according to another aspect of the present invention.

It may be desirable in some applications to provide the sleeve valve with a port-recloseable function. For example, in some applications it may be useful to open ports 28 to permit fluid flow therethrough and then later close the ports to shut in the well. This reclosure may be useful for wellbore treatment (i.e. soaking), for back flow or production control, etc. As such sleeve 14 may be moveable from the third position to a position overlying and blocking flow through ports. Alternately, in another embodiment with reference to FIG. 2, another downhole tool may be provided with a sleeve valve including a sleeve 48 in a tubular segment 49, the sleeve being moveable from a position initially overlying and closing ports 50 to a position away from the ports (as shown), wherein ports 50 become opened for fluid flow therethrough. To provide a recloseable functionality for ports 50, tubular segment 49 may include a second sleeve 51 that is positioned adjacent ports 50 and moveable from a position away from the ports to a position overlying and closing them. Second sleeve 51, for example, may be positioned on a side of the ports opposite sleeve 48 and can be moved into place when and if it is desired to close the ports. Sleeve 51 may include seals 52 to seal between the tubular segment and the sleeve, if desired. Sleeve 51 may be capable of moving in any of various ways. In one embodiment, for example, sleeve 51 may include a shifting catch groove 53 allowing it to be engaged and moved by a shifting tool conveyed and manipulated from surface. Alternately, sleeve 51 may include seat to catch a drop plug so that it can be moved into a sealing position over the ports. Sleeve 51 may include a releasable setting device such as a shear pin, a collet or a spring that holds the sleeve in place until the holding force of the releasable setting device is overcome. Sleeve 51 may be reopenable, if desired, by engaging the sleeve again and moving it away from ports 50. Another valve according to an aspect of the present invention is shown in FIG. 18. In this embodiment, the valve is designed to allow for a single pressure cycle to move the valve from a first, closed position (as shown), to a second closed and activated position and thereafter it cycles from the closed activated position to a third, open position. The valve may be moved from the closed position to the closed and activated position by differential pressure from tubing to annulus and may include a driver to bias the sleeve from the closed but activated position to the open position. The valve driver may include a spring, a pressure chamber containing nitrogen or atmospheric gas that will be worked on by hydrostatic pressure or applied pressure in the wellbore.

The valve of FIG. 18 comprises an outer tube, also termed a housing 202 that has threaded ends 201 such that it is attachable to the tubing or casing string in the well. The outer tube in this embodiment, includes an upper housing 202*a* and a lower housing 202*b* that are threaded together to form the final housing. The outer housing has a port 204 through its side wall that is closed off by an inner tube 213 that serves both as a sealing sleeve and as a piston. As the tool is assembled, a spring 206 is placed to act between the inner tube and the housing. It shoulders against an upset 205 in the outer housing. The inner tube is installed with seals 209 and 203 that form a seal between the housing and the inner tube, and that seal above and below ports 204 in the outer housing.

Seals 203, 209 are positioned to create a chamber 212 in communication with the outer surface of the housing through ports. As such, a piston face 210 is formed on the inner tube that can be affected by pressure differentials between the inner diameter of the housing and the annulus.

When the inner tube 213 is installed, it traps the spring 206 between a shoulder 207 on the inner tube and upset shoulder 205 on the housing and radially between itself and the housing. As the inner tube is pushed into place, it compresses the spring 206. The spring is compressed and the inner tube is pushed into the outer tube until a slot in the piston becomes lined up with the shear screw holes in the outer housing. Once this alignment is achieved, shear screws 208 are installed locking the inner tube in position.

As the inner tube of a sleeve valve in generally positioned in an annular groove to avoid restriction of the inner diameter, it is noted that a gap 215 remains between the top of the inner tube and any shoulder 214 forming the upper end of the annular groove. This gap is required to allow movement of the inner tube within the housing. In particular, pressure applied internally will act against piston face 210 and force the inner tube to move upward (away from the end on which piston face 210 is formed). This upward movement will load into the shear pins. Once the force from the internal pressure is increased to a predetermined amount, it will shear the pins 208 allowing the inner tube to move upward until the upper end of the inner tube contacts the shoulder 214 on the housing. When the piston is forced against the housing shoulder, the valve is positioned in the activated and closed position.

The valve will remain in the activated and closed position as long as the internal pressure is sufficient to keep the spring compressed. The pressure differential across face 210 prevents the sleeve from moving down. The tubing pressure can be maintained for an indefinite period of time. Once the pressure differential between the tubing inner diameter and the chamber 212 (which is annular pressure) is dissipated such that the force of spring can overcome the holding force across face 210, the inner tube will be driven down to open the ports.

As the spring expands, it pushes against the shoulders 205 and 207 and moves the inner tube down so that the upper seals 203 move below the port 204 in the outer housing. The valve is then fully open, and fluids from inside the tubing string can be pumped into the annulus, or can be produced from the annulus into the tubing.

The valve can also contain a locking device to keep it in the open position or it can contain the ability to close the piston by forcing it back into the closed position. It may also contain a separate closing sleeve to allow a sleeve to move across the port 204, if required.

While the sleeve is held by tubing pressure against shoulder 214, pressure can be held in the tubing string. At this time tubing or casing pressure operations can be conducted, if desired, such as setting hydraulically actuated packers, such as hydraulically compressible or inflatable packers. Once pressure operations are conducted and completed, the pressure between the tubing and annulus can be adjusted towards equalization, which will allow the driver to open the ports closed by the inner tube.

Several of these valves can be run in a tubing string, and can be moved to the activated but closed and the open positions substantially simultaneously.

The pressures on either side of piston face 210 can be adjusted toward equalization by releasing pressure on the tubing at surface, or by opening a hydraulic opened sleeve or pump-out plug downhole. For example, once a single valve is opened, allowing the pressure to equalize inside and outside of the tubing, all the valves in the tubing string that have been activated will be moved to the open position by the driver, which in this case is spring 206. In one embodiment, for example, a plurality of sleeves as shown in FIG. 18 can be employed that become activated but closed at about 2500 to 3500 psi and additionally a hydraulically openable port could be employed that moves directly from a closed to an open position at a pressure above 3500 psi, for example at about 4000 psi, to provide for pressure equalization on demand. As such, an increase in tubing pressure to at least 2500 psi would cause the inner tubes of the valves of FIG. 18 to be activated but held closed and, while the inner tubes are held in a closed position, tubing pressure could be further increased to above 3500 psi to open the port to cause equalization, thereby dissipating the pressure differential to allow the inner tubes to move away from ports 204, as driven by spring 206. A suitable hydraulically openable sleeve is available as a FracPORT™ product from Packers Plus Energy Services Inc.

These tools can be run in series with other similar devices to selectively open several valves at the same time. In addition, several series of these tools can be run, with each series having a different activation pressure.

Figure 3:
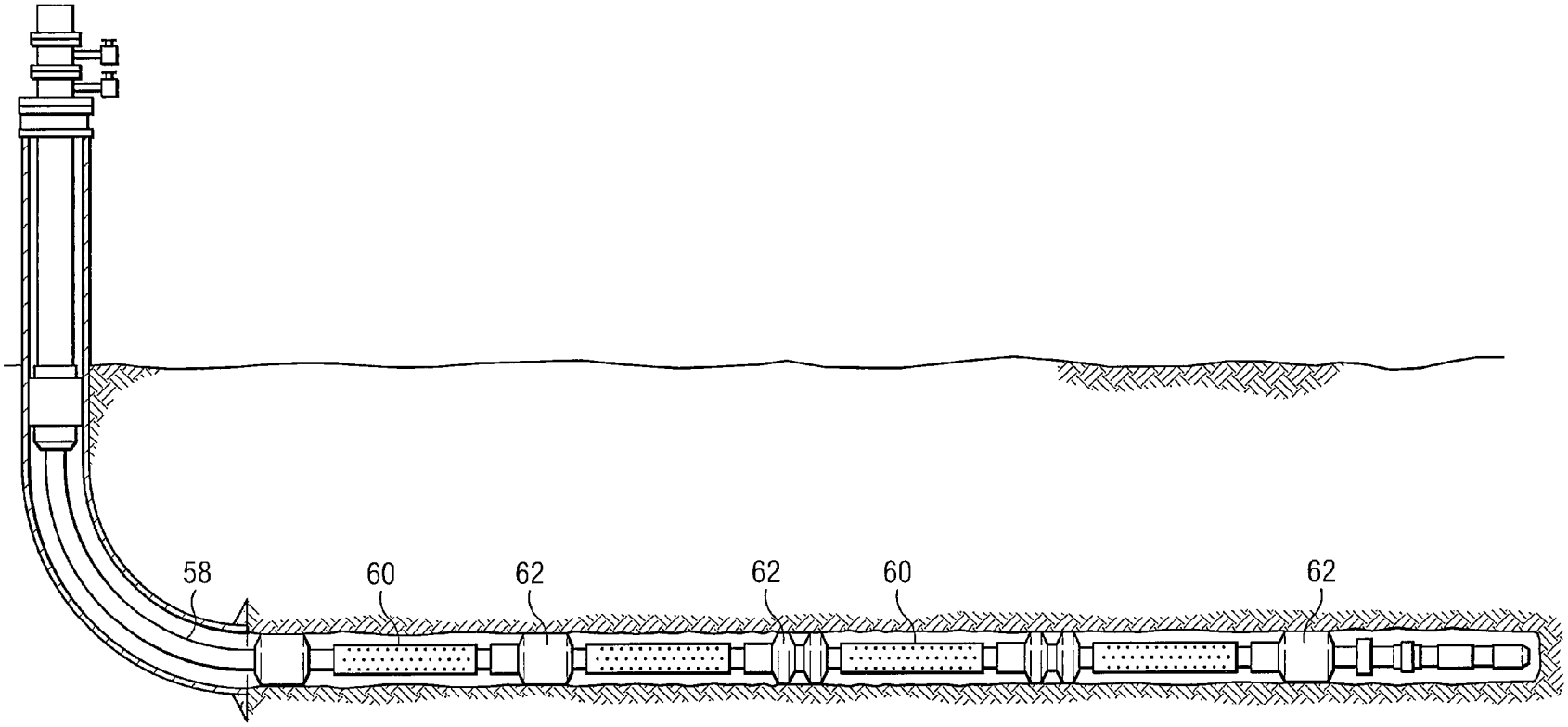
FIG. 3 is schematic sectional view through a wellbore with a tubing string installed therein.

As shown in FIG. 3, a downhole tool including a valve according to the present invention can be used in a wellbore string 58 where it is desired to activate multiple sleeves on demand and at substantially the same time. For example, in a tubular string carrying a plurality of ICD or screen devices 60, sleeve valves, such as one of those described herein above or similar, can be used to control fluid flow through the ports of devices 60. Such sleeve valves may also or alternately be useful where the tubing string carries packers 62 that must first be pressure set before the sleeves can be opened. In such an embodiment, for example, the pressure up condition required to set the packers may move the sleeves into the second position, where they continue to cover ports and hold pressure, and a subsequent pressure relaxation may then allow the sleeves to be driven to open the ports in devices 60 to permit fluid flow therethrough. Of course, even if the tubing string does not include packers, there may be a desire to install a tubing string with its flow control devices 60 in a closed (non-fluid conveying) condition and to open the devices all at once and without physical manipulation thereof and without a concern of certain devices becoming opened to fluid flow while others fail to open because of early pressure equalization caused by one sleeve valve opening before the others (i.e. although the sleeve valves are released hydraulically to be capable of opening, even if one sleeve opens its port first, the others are not adversely affected by such opening). In such applications, the sleeve valves described herein may be useful installed in, on or adjacent devices 60 to control fluid flow therethrough. One or more sleeve valve may be installed to control flow through each device 60.

An indexing J keyway may be installed between the sleeve and the tubular segment to hold the sleeve against opening the ports until a selected number of pressure cycles have been applied to the tubing string, after which the keyway releases the sleeve such that the driver can act to drive the sleeve to the third, port open position. An indexing J keyway may be employed to allow some selected sleeves to open while others remain closed and only to be opened after a selected number of further pressure cycles. The selected sleeves may be positioned together in the well or may be spaced apart.

For example, referring to the drawings and particularly to FIGS. 4-9, there is shown an apparatus 120 for placing in a wellbore through a formation to effect fluid handling therethrough. In this embodiment, the apparatus is described for fluid handling is for the purpose of wellbore stimulation, and in particular fracing. However, the fluid handling could also be for the purposes of handling produced fluids.

The illustrated apparatus 120 comprises the plurality of fracing mechanisms 121, 122 each of which includes at least one port 142 through which fluid flow may occur. A plurality of packers 124 are positioned with one or more fracing mechanisms 121, 122 therebetween along at least a portion of the length of the apparatus 120. In some cases, only one fracing mechanism is positioned between adjacent packers, such as in Area I, while in other cases there may be more than one fracing mechanism between each set of adjacent packers, as shown in Area VIII. Although the packers 124 are generically illustrated in FIGS. 4-9, the packers 124 may, for example, comprise Rockseal® packers of the type manufactured and sold by Packers Plus Energy Services Inc. of Calgary, Alberta, Canada, hydraulically actuable swellable polymer packers, inflatable packers, etc.

By way of example, the apparatus 120 in the illustration is divided into eight areas designated as Areas I-VIII (Areas III through VII are omitted in the drawings for clarity). In this example, as illustrated, each area comprises four fracing mechanisms 121 or 122 which are designated in FIGS. 4-9, inclusive, by the letters A, B, C and D. Thus, the apparatus 120 comprises thirty-two fracing mechanisms 121, 122. As will be understood by those skilled in the art, the apparatus 120 may comprise as many fracing mechanisms as may be required for particular applications of the invention, the fracing mechanisms can be arranged in one or more areas as may be required for particular applications of the invention, and each area may comprise one or more fracing mechanisms depending upon the requirements of particular applications of the invention. The amount of fracing fluid that can exit each of the ports of the fracing mechanisms, when they are open, may be controlled by the sizing of the individual frac port nozzles. For example, the ports may be selected to provide limited entry along an Area. Limited entry technology relies on selection of the number, size and placement of fluid ports 142 along a selected length of a tubing string such that critical or choked flow occurs across the selected ports. Such technology ensures that fluid can be passed through the ports in a selected way along the selected length. For example, rather than having uneven flow through ports 142 of mechanisms 122 A, B, C and D in Area VIII, a limited entry approach may be used by selection of the rating of choking inserts in ports 142 to ensure that, under critical flow conditions, an amount of fluid passes through each port at a substantially even rate to ensure that a substantially uniform treatment occurs along the entirety of the wellbore spanned by Area VIII of the apparatus.

Figure 4:
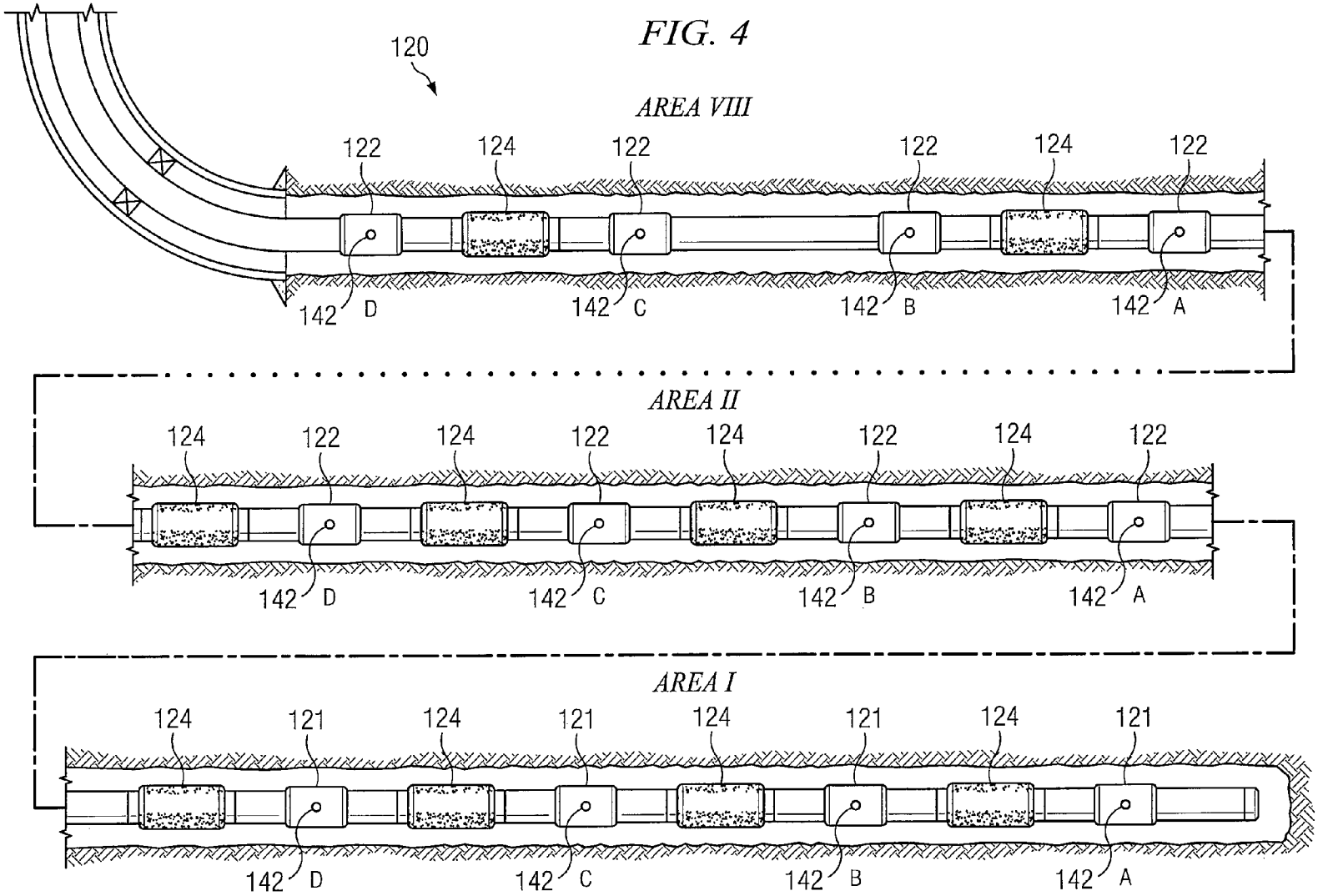
FIG. 4 is a diagrammatical illustration of a tubing string incorporating the present invention installed in a hydrocarbon well prior to activation of the packers thereof.
Figure 5:
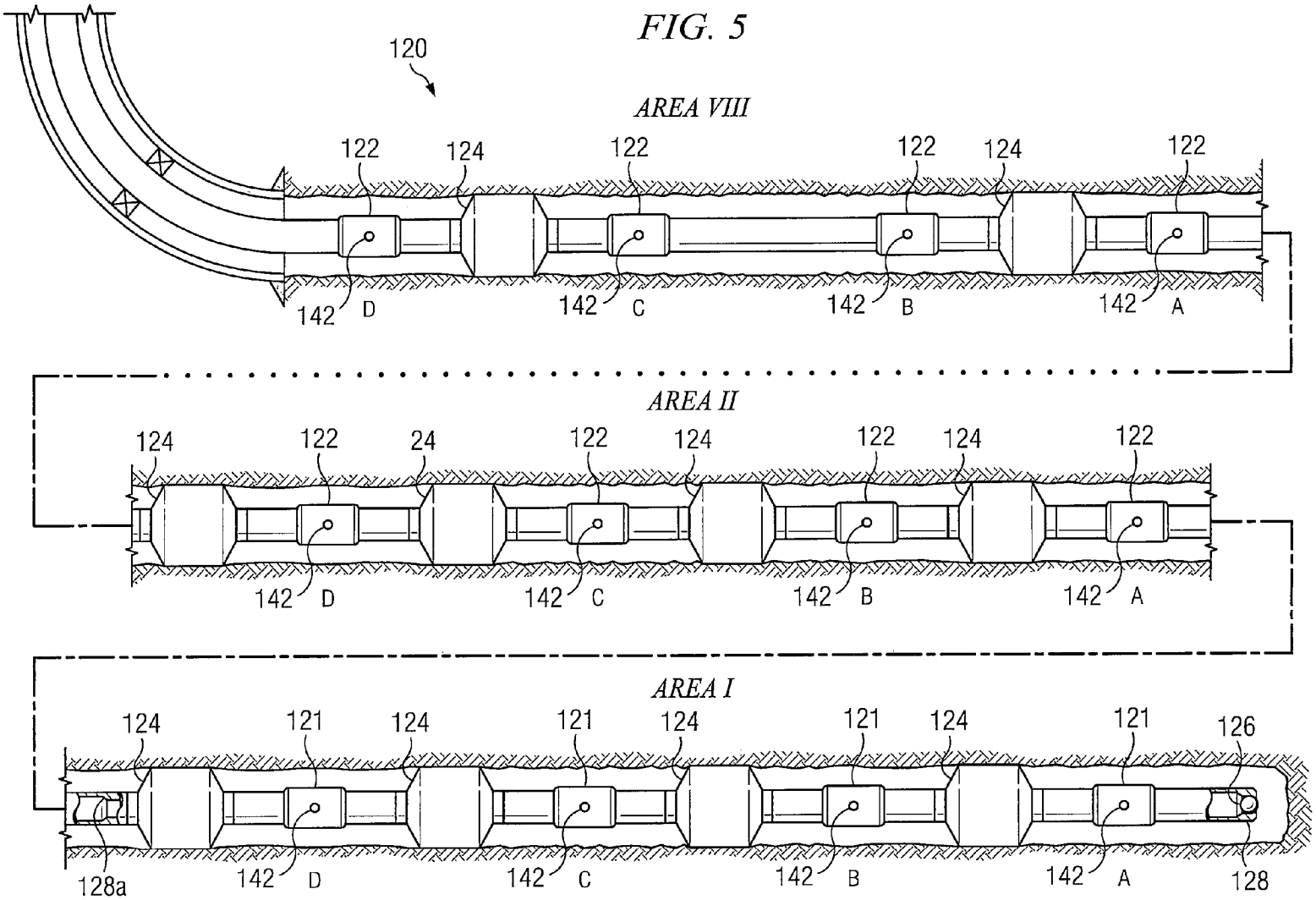
FIG. 5 is a view similar to FIG. 4 illustrating the tubing string following actuation of the packers.
Figure 6:
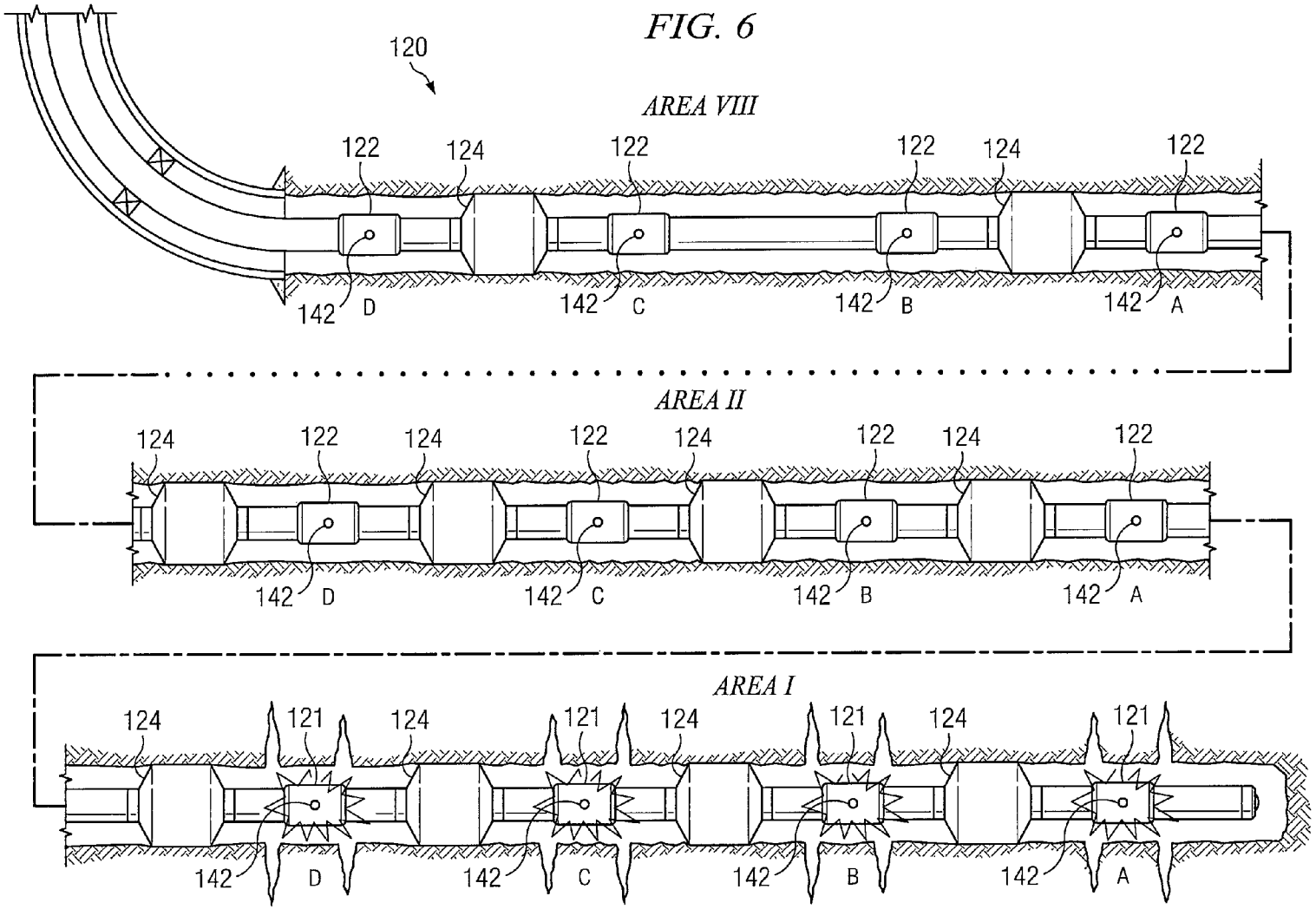
FIG. 6 is a view similar to FIG. 4 illustrating actuation of and fracing through the fracing ports comprising the first area of the tubing string.
Figure 7:
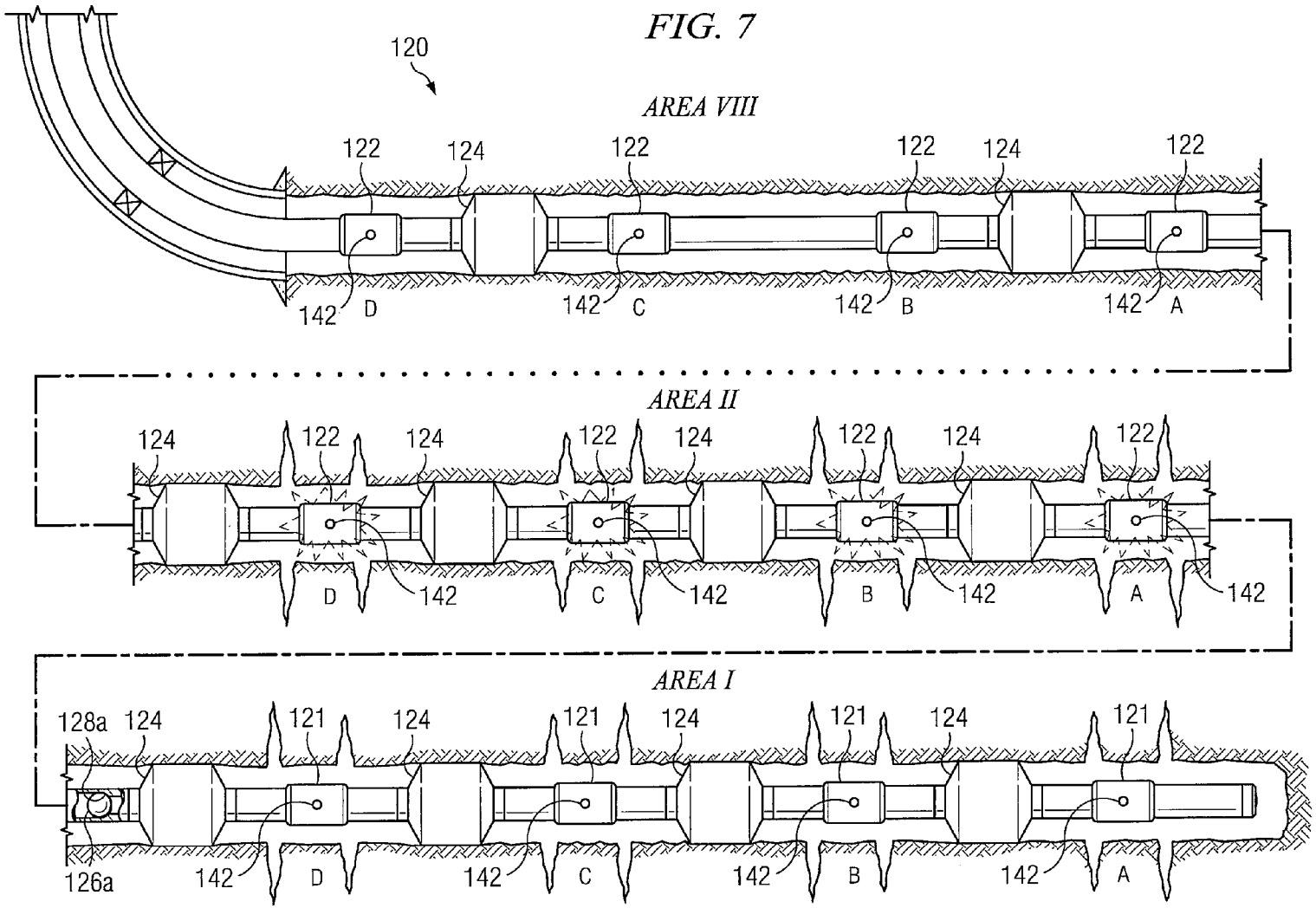
FIG. 7 is a view similar to FIG. 4 illustrating actuation of and fracing through the fracing ports comprising the second area of the tubing string.
Figure 8:
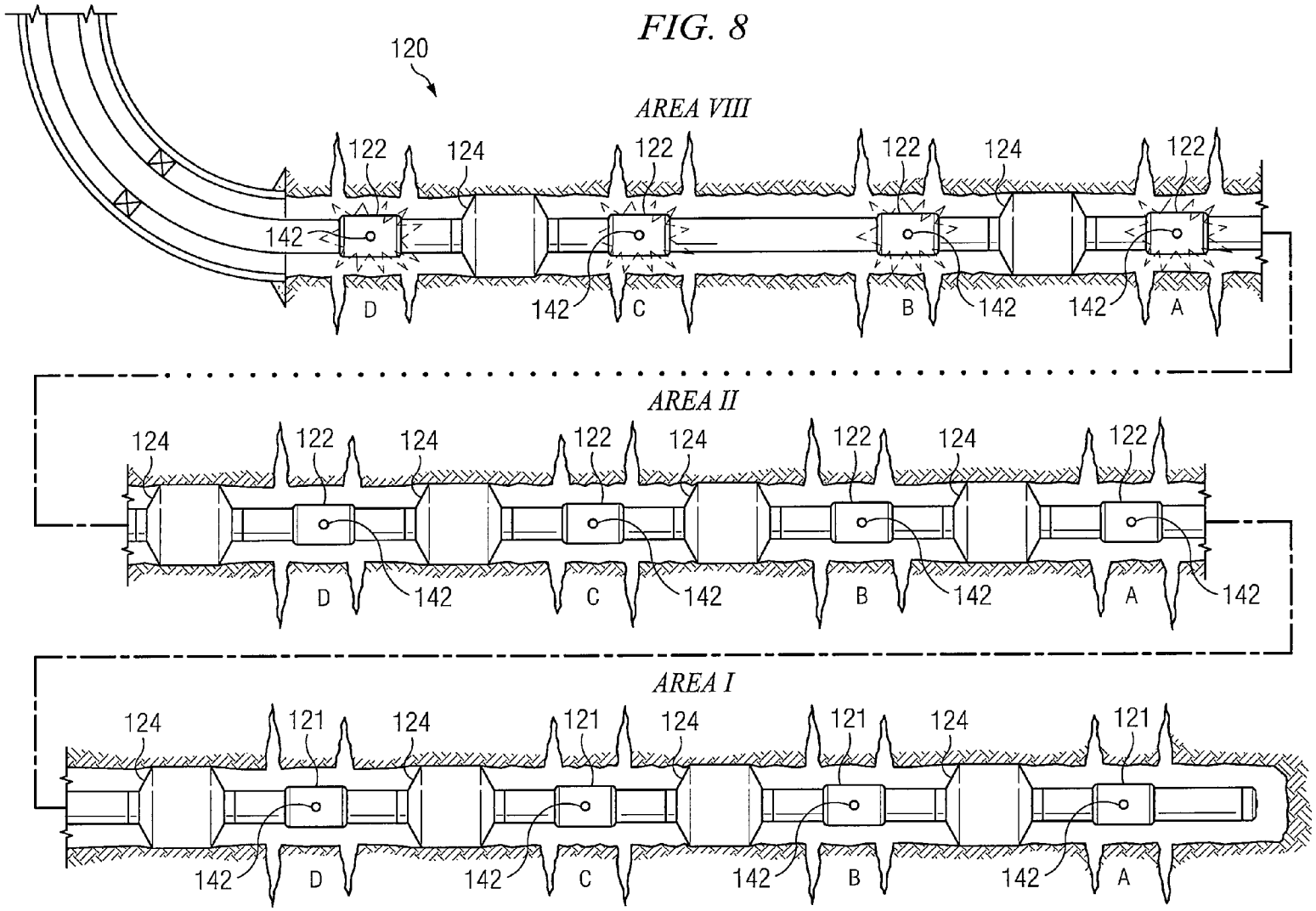
FIG. 8 is an illustration similar to FIG. 4 illustrating the actuation of and fracing through the fracing ports comprising the eighth area of the tubing string.
Figure 9:
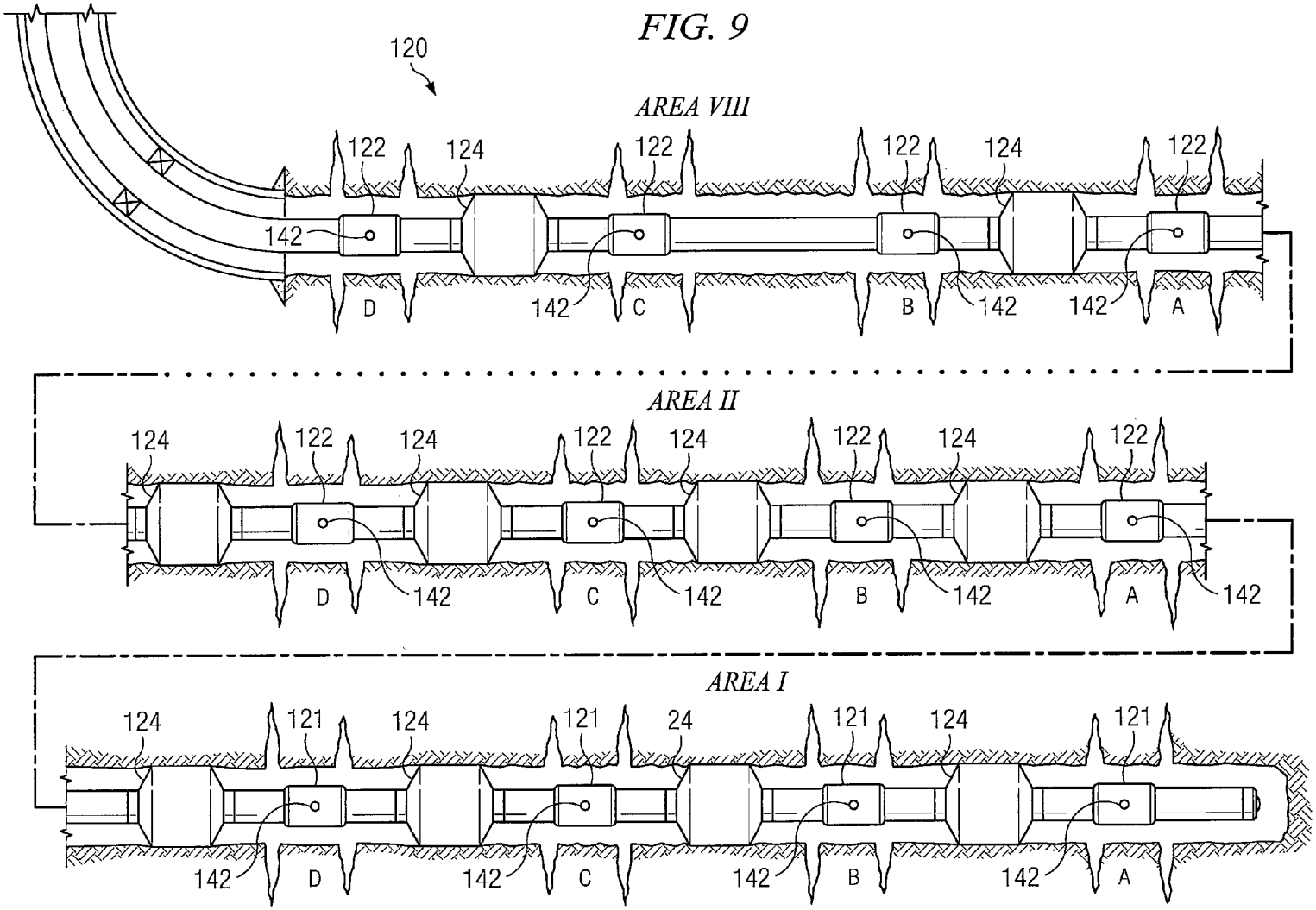
FIG. 9 is a view similar to FIG. 4 illustrating completion of the actuation of the fracing ports.

Referring first to FIGS. 4 and 5, the apparatus 120 is initially positioned in a hydrocarbon well with each of the packers 124 being in its non-actuated state. The distal end of the tubing string comprising the apparatus 120 may be initially open to facilitate the flow of fluid through the tubing string and then back through at least a portion of the well annulus toward surface to condition the well. At the conclusion of the conditioning procedure, a ball 126 is passed through the tubing string until it engages a ball receiving mechanism 128, such as a seat, thereby closing the distal end of the tubing string. After the ball 126 has been seated, the tubing string is pressurized thereby actuating the packers 124. FIG. 5 illustrates the apparatus 120 after the packers 124 have been actuated.

All of the fracing mechanisms in a single area can be opened at the same time. In other words, fracing mechanisms 121 A, B, C and D that reside in Area I (the area nearest the lower end of the well) all open at the same time which occurs after pressurization takes place after ball 126 seats. The fracing mechanisms 122 A, B, C and D, etc. of Areas II, III, etc. remain closed during the opening of fracing mechanisms 121 of Area I and possibly even during any fracing therethrough. Once the Area I mechanisms are open, and if desired the frac is complete, another ball 126*a* is dropped that lands in a ball receiving mechanism 128*a* above the top fracing mechanism 121D in Area I. This ball provides two functions; first, it seats and seals off the open fracing mechanisms 121 in Area I; and second, it allows pressure to be applied to the fracing mechanisms 122 that are located above Area I. This next pressurization opens all of the fracing ports in Area II (which is located adjacent to and up-hole from Area I in the string). At the same time, the fracing mechanisms in Area III and higher remain closed. After completing a frac in Area II, another ball is dropped that seats above the fracing mechanisms in Area II and below the fracing mechanisms in Area III, the string is pressured up to open the mechanisms of Area III, and so on.

The fracing mechanisms 121 of Area I may be as described above in FIG. 1 or 2, such that they may be opened all at once by a single pressure pulse. For example, the mechanisms may be released to open by an increase in tubing pressure as affected after ball 126 seats and when packers are being set and may be driven to open as tubing pressure is released. However, the fracing mechanisms 122 of the remaining areas remain closed during the initial pressure cycle and only open after a second or further pressure up condition in the string. FIGS. 10-17 illustrate the construction and operation of a possible fracing mechanism 122 of the apparatus 120. Fracing mechanism 122 comprises a tubular body including an upper housing 136 and a lower housing 138, which is secured to the upper housing 136. A sleeve-type piston 140 is slidably supported within the upper housing 136 and the lower housing 138. Piston 140 includes a face 149 acted upon by tubing pressure, while the opposite end of the piston is open to annular pressure. The upper housing 136 is provided with a plurality of frac ports 142. The number, diameter and construction of the frac ports 142 may vary along the length of the tubing string, depending upon the characteristics of various zones and desired treatments to be effected within the hydrocarbon well. The frac ports are normally closed by the piston 140 and are opened when apertures 144 formed in the piston 140 are positioned in alignment with the frac ports 142. The fracing mechanism includes a driver such as an atmosphere trap 143, a spring, etc.

Figure 10:
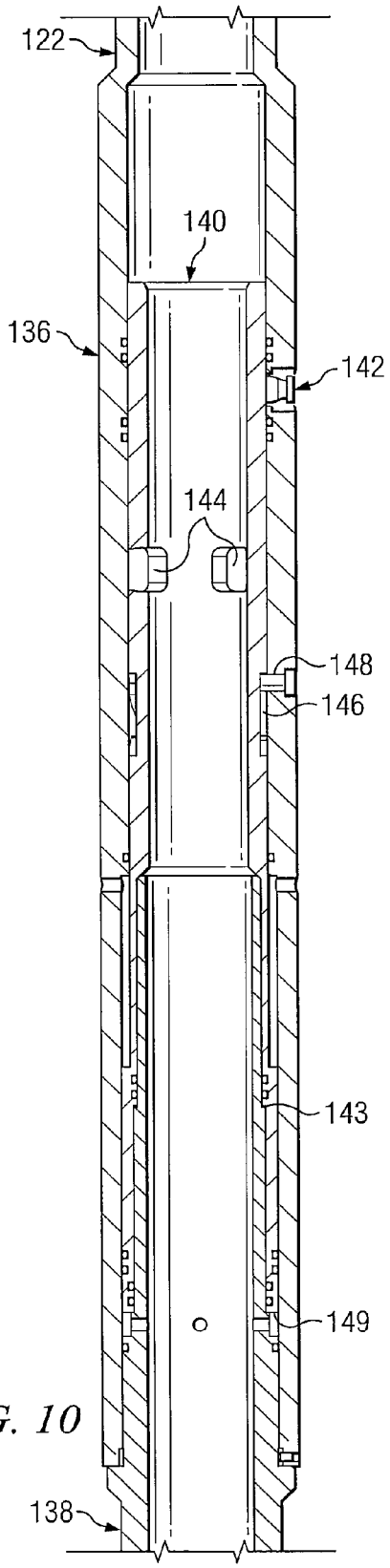
FIG. 10 is a sectional view illustrating the run-in configuration of a downhole tool according to another aspect of the invention and useful in the practice of the method referenced in FIGS. 4 to 9.

FIG. 10 illustrates the fracing mechanism 122 with the piston 140 in its lower most position.

Figure 11:
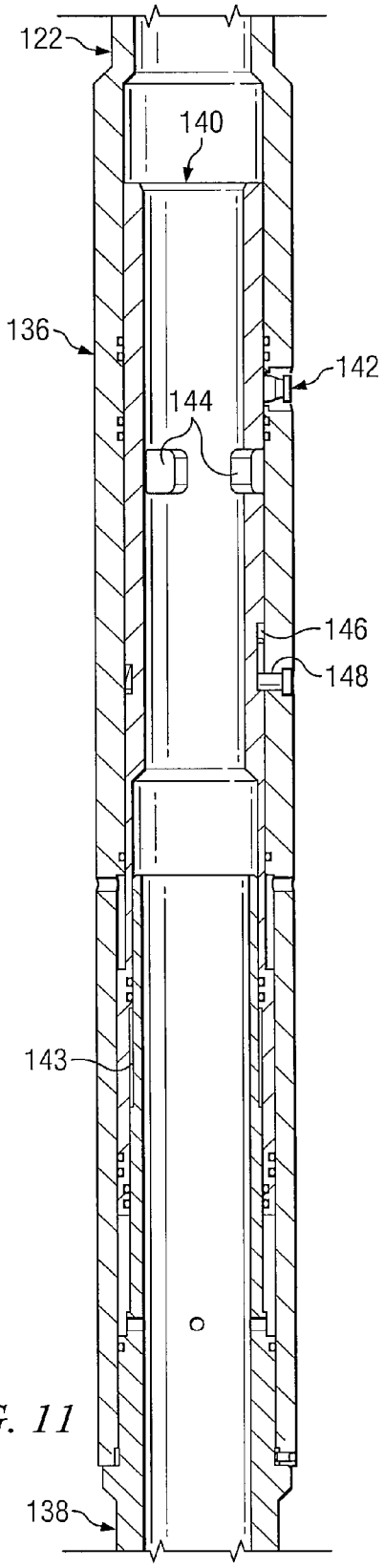
FIG. 11 is a view similar to FIG. 10 illustrating another position of the tool of FIG. 10.

FIG. 11 illustrates the fracing mechanism 122 with the piston 140 located somewhere above its location as illustrated in FIG. 10, as driven by pressure applied against face 149 which is greater than annular pressure.

Figure 12:
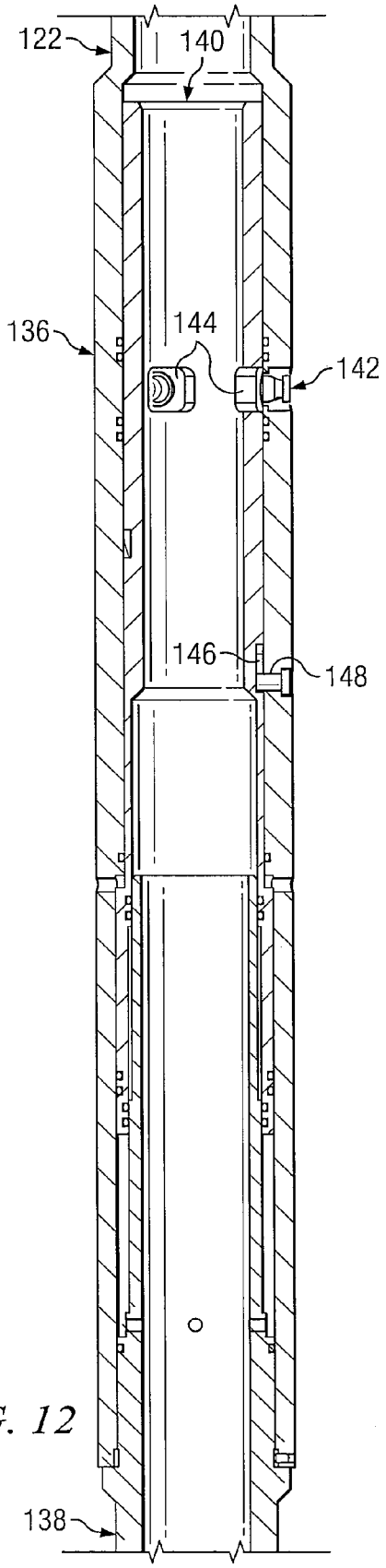
FIG. 12 is a view similar to FIG. 10 illustrating the frac position of the tool.

FIG. 12 illustrates the frac port 122 with the piston 140 in its uppermost position wherein the apertures 144 align with the frac ports 142.

Figure 13:
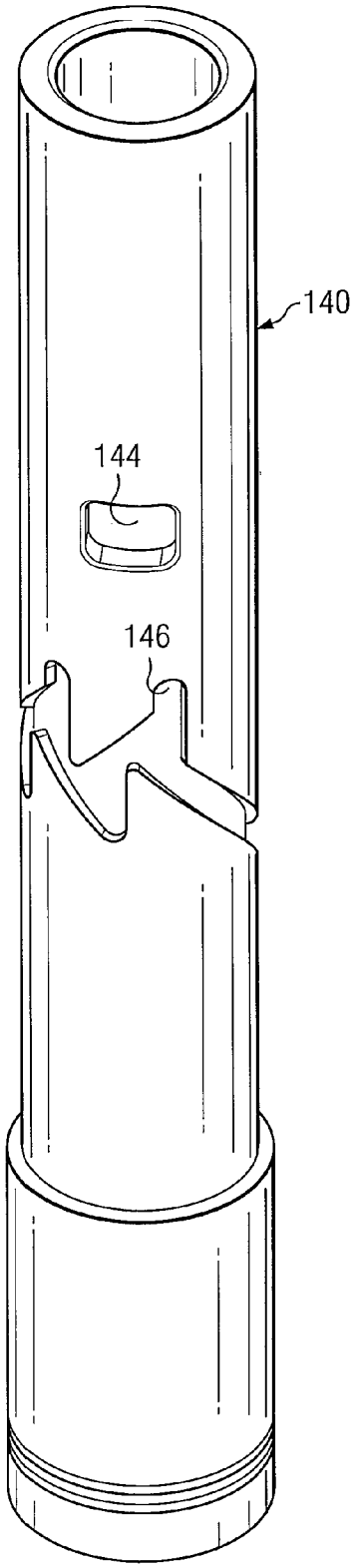
FIG. 13 is a perspective view of the tool of FIG. 10.

Referring to FIG. 13, the piston 140 of each fracing mechanism 122 is provided with a slot 146 which engages, and rides over a J-pin 148 as shown in FIGS. 10-12. The J-pin 148 is installed, as by sealable engagement with the upper housing 136.

Figure 14:
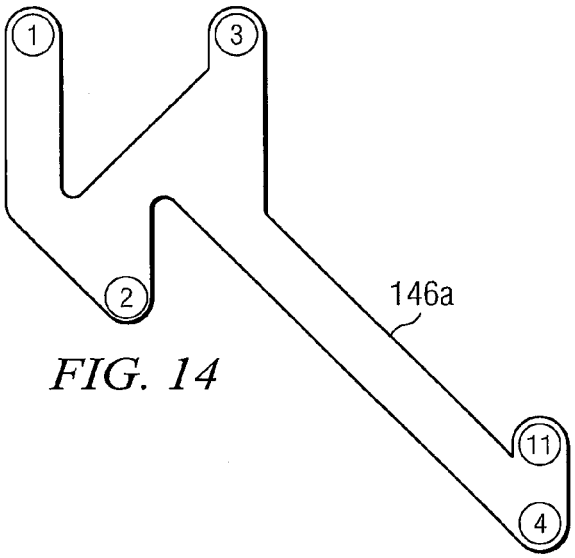
FIG. 14 is an illustration of the configuration of the tool of FIG. 10 for the second area fracing mechanism as illustrated in FIGS. 4-9.

FIG. 14 illustrates, as an example, the profile of the slot 146*a* formed in the exterior wall of the piston 140 for use in all Area II mechanisms. The J-pin 148 initially resides in position 1 in the slot 146*a*. When the apparatus 120 is first pressurized to set the packers 124, the piston moves as by pressure applied against face 149, so that the J-pin 148 resides in position 2. When the pressure is released, the piston is driven, as by hydrostatic pressure creating a differential relative to chamber 143, so that the J-pin 148 resides in position 3, and when the apparatus 120 is pressurized the second time, the piston moves so that the J-pin 148 resides in position 4. Upon release of the second pressurization within the apparatus 120, the piston is biased by the driver so that the J-pin 148 resides in position 11 whereupon the apertures 144 in the piston 140 align with the frac ports 142 formed through the upper housing 136 of the fracing mechanism 122 thereby opening the ports at Area II and, if desired, facilitating fracing of the portion of the hydrocarbon well located at Area. II. As will be appreciated by those skilled in the art, the fracing ports located in Area II are simultaneously opened upon the second pressurization and release thereof.

Figure 15:
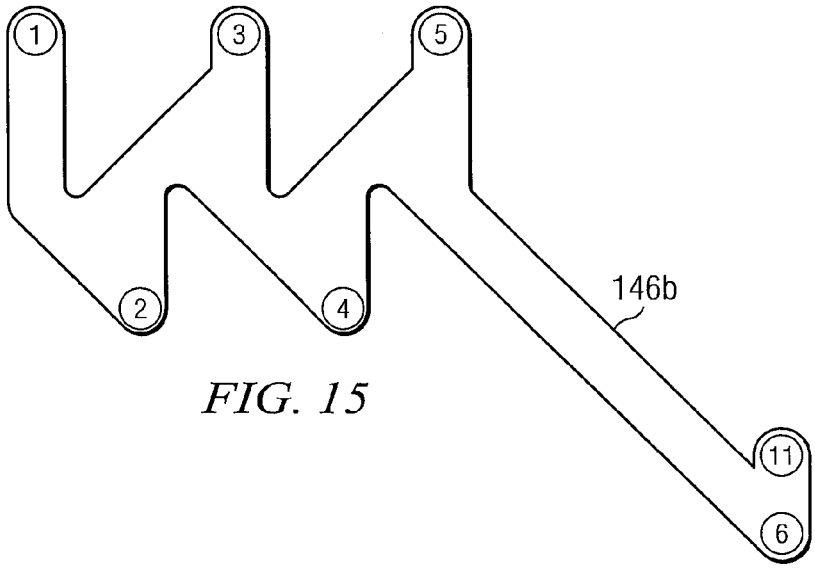
FIG. 15 is an illustration of the configuration of the tool of FIG. 10 for the third area fracing mechanism as illustrated in FIGS. 4-9.

FIG. 15 illustrates the profile of a slot 146*b* for all Area III tools. The profile illustrated in FIG. 15 operates identically to the profile illustrated in FIG. 14 as described herein in conjunction therewith above except that an additional pressurization and release cycle is required for the J-pin to arrive at position 11, thereby aligning the apertures 144 in the piston 140 with the fracing ports 142 of the tool.

Figure 16:
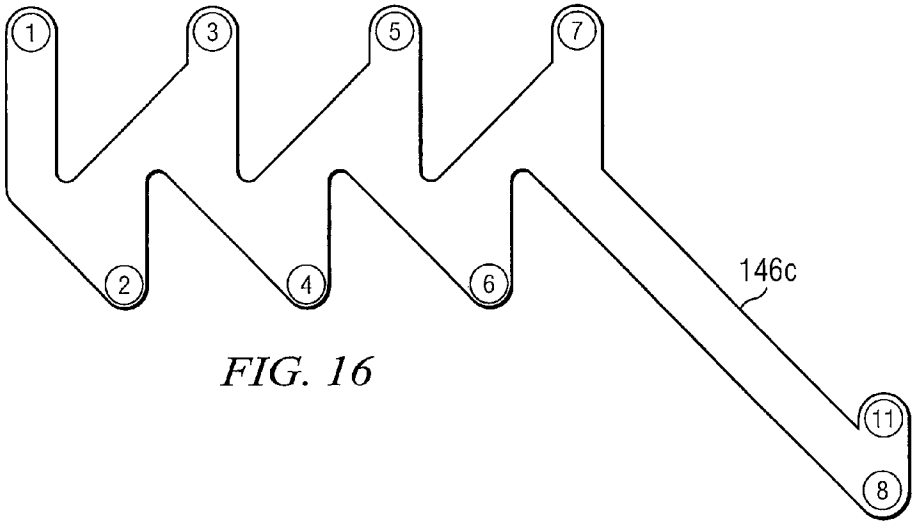
FIG. 16 is an illustration of the configuration of the tool of FIG. 10 for the fourth area fracing mechanism as illustrated in FIGS. 4-9.

FIG. 16 illustrates the profile of the slot 146*c* for all Area IV tools. The configuration of slot 146*c* shown in FIG. 16 operates identically to that of the slot 146*b* shown in FIG. 15 except that an additional pressurization and release is necessary in order to bring the J-pin riding in slot 146*c* into position 11, thereby aligning the apertures 144 of the piston 140 with the fracing ports 142.

Figure 17:
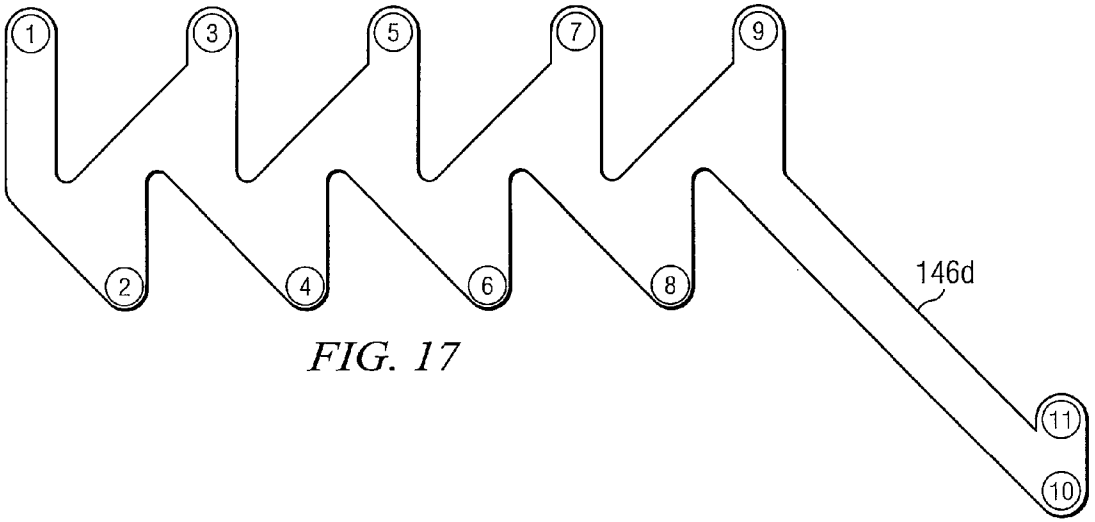
FIG. 17 is an illustration of the configuration of the tool of FIG. 10 for the fifth area fracing mechanism as illustrated in FIGS. 4-9.
Figure 19:
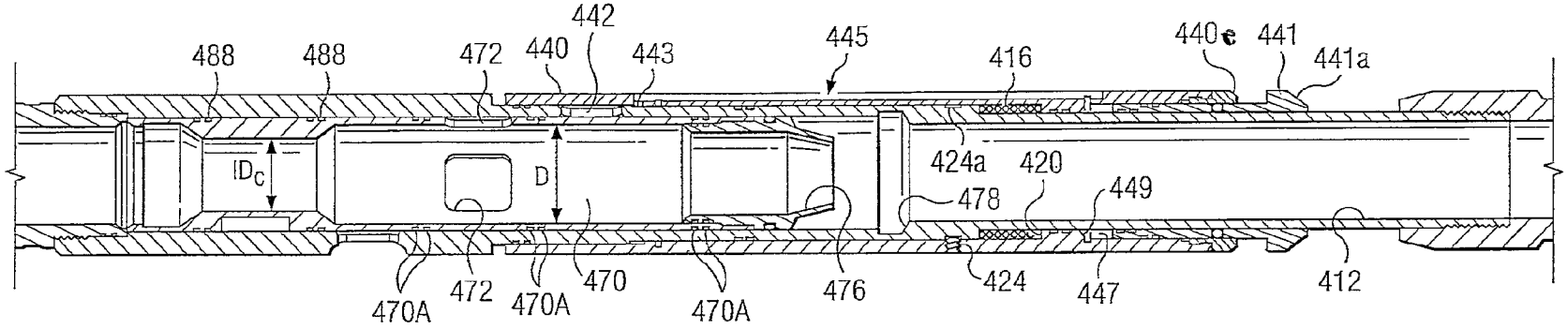
FIG. 19 is a sectional view illustrating the run-in configuration of a downhole tool according to another aspect of the invention.

FIG. 17 illustrates the profile of the slot 146*d* as used in all of the Area V tools. The operation of the slot 146*d* of the Area V tools is substantially identical to that of the Area IV tools except that an additional pressurization and release is necessary in order to bring the J-pin riding in that slot to position 11 wherein the apertures 144 of the piston 140 are aligned with the fracing ports 142 to effect fracing of the Area V location of the well.

Those skilled in the art will understand that the pattern of the slots can be continued by wrapping the slot around the extension of the piston to the extent necessary to open all of the facing ports 142 comprising particular applications of the invention.

Those skilled in the art will also realize and appreciate that although the present invention has been described above and illustrated in the drawings as comprising eight areas other configurations can also be used depending upon the requirements of particular applications of the invention. For example, the number of areas comprising the invention can be equal to, greater than, or less than eight.

In the embodiments of FIGS. 10 to 12, the valves can be opened when it is selected to do so. As such if a string includes a plurality of pressure cycle openable valves, some valves can be opened while others remain closed. In that embodiment, the selective opening may be based on the number of pressure cycles applied to the valve. In another embodiment, valves can be opened when it is selected to do so, while others remain closed, as by isolation of tubing pressure from the valve piston until it is desired to open the valve piston to communication' with the pressure cycles.

Figure 20:
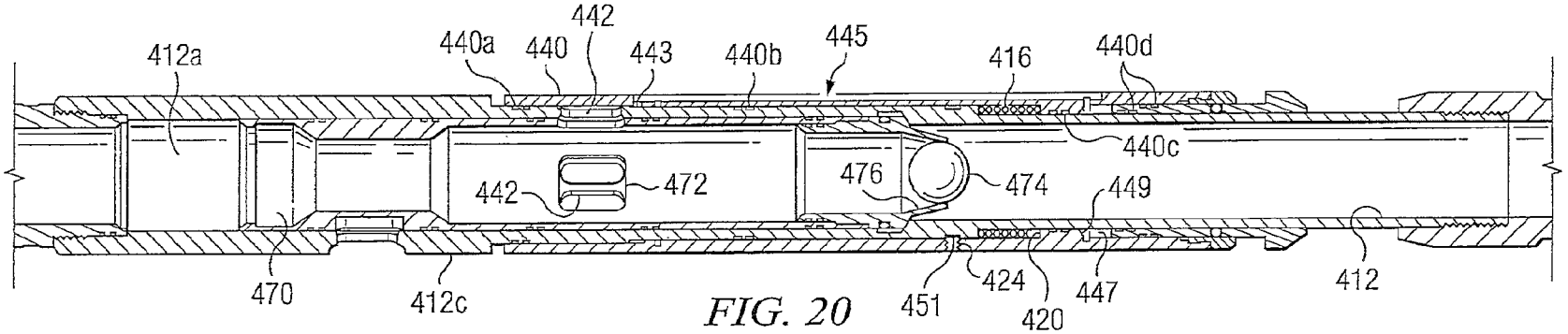
FIG. 20 is a view illustrating a readied, non tubing pressure isolated position of the tool of FIG. 19.

In one embodiment, for example the sub can include an isolator that isolates tubing pressure from the pressure actuated components of the sleeve until it is desired to open the sleeve to tubing pressure. For example, the tool of FIGS. 19 to 23 illustrate a sleeve valve sub installed in a tubing string, the sub including a tubular body 412 with fluid treatment/production ports 442 therethrough closed by a valve in the form of a sleeve 440 that is released for movement to open the ports by pressure cycling. In particular, in a similar manner to the sub of FIG. 1, the sleeve 440 of the sub of FIGS. 19 to 23 can be driven (by generating a pressure differential across the sleeve) from a first position to a second position, which allows the sleeve to be further acted upon by a driver 416 to move into a third position: opening the ports. However, the sleeve valve sub in this illustrated embodiment further includes an isolator, in this embodiment in the form of an isolation sleeve 470 that can, depending on its position, selectively isolate or allow communication of tubing pressure from/to sleeve 440. As such, sleeve 440 is not affected by tubing pressure and a pressure differential cannot be established, when the isolator, such as isolation sleeve 470, is in an active position but may be actuated by the tubing pressure when the isolator is disabled. The isolator may be actuated in various ways to open tubing pressure access to the piston face of sleeve 440. In the illustrated embodiment, for example, where the isolator includes isolation sleeve 470, the isolation sleeve may be moved along the tubular body from a position closing access to the piston face (FIG. 19) to a position allowing access to the piston face (FIG. 20).

The isolation sleeve includes seals 470*a* that isolate tubing pressure from the piston face of sleeve 440, when the sleeve is in the position closing access. However, sleeve 470 includes an access port 472 that can be moved into alignment with the tubing pressure fluid access channel to the piston face of sleeve 440 to allow tubing pressure communication to the piston face. If the sleeve overlies fluid treatment/production ports 442, the sleeve, when positioned to permit communication to the fluid access channel (FIG. 20), may also be retracted to permit ports to be open to some degree. In the illustrated embodiment, as will be better understood with reference to the description of sleeve 440 below, the fluid access channel to the sleeve's piston face is through fluid treatment/production ports 442 and, as such, the movement of access port 472 into alignment with the fluid access channel also serves to open ports 442. It will be appreciated that other arrangements may be possible depending on the length and form of isolation sleeve 470 and the form and positions of the fluid access channel and ports 442.

Isolation sleeve 470 may be moved, by any of various methods and/or mechanisms, along the tubular body from the position closing access to the piston face to the position allowing access to the piston face. For example, sleeve 470 may be moved using actuation by a downhole tool from surface, electrically or remotely by mechanical means unattached to surface. For example, in the illustrated embodiment, sleeve 470 may be moved by landing a ball 474 or other plugging device such as may include a dart, plug, etc., in a sleeve shifting seat 476 (FIG. 20). In such an embodiment, ball 474, which is selected to land and seal against seat 476, may be launched from surface to arrive at, as by fluid carriage or gravity, and seal against the seat. Fluid pressure may then be built up behind the ball to create a pressure differential to drive the sleeve along the tubular body 412 of the sub.

To better understand the operation of isolation sleeve 470 and sleeve 440, the operation of sleeve is discussed below.

As shown in the illustrated embodiment, for example, the sleeve valve sub may include tubular body 412 with ports 442 extending to provide fluid treatment/production communication between the inner bore 412*a* of the tubular body and its outer surface 412*c*. Ports 442 may be closed (FIGS. 19-21) and opened (FIG. 22) to fluid flow therethrough by a valve in the form of sleeve 440 that rides along the tubular body and, in this illustrated embodiment, axially along the outer surface of the tubular body. Because sleeve 440 is positioned on the outer surface, it may be subject to shocks during installation. As such the leading ends 440*e*, 441*a* of sleeve 440 and its support structure 441 may be chamfered to facilitate riding over structures and resist catching. While the illustrated embodiment shows sleeve 440 as riding along the outer surface, other positions are possible such as in an intermediate position or beneath an outer protective sleeve. Sleeve 440 includes a face 449 that can be acted upon by tubing pressure while an opposite face 420 is open to annular pressure. Tubing pressure is conveyed by a fluid channel defined in sequence through ports 442, an annulus 443 between tubular body 412 and sleeve 440, a channel (generally indicated at 445) and into chamber 447. Seals 440*a*, 440*b*, 440*c*, 440*d* contain and direct any fluid through the channel defined by the foregoing interconnected parts. Channel 445 can be provided in various forms such as bore drilled axially through sleeve 440, a groove formed along a surface of the sleeve, an installed conduit, etc. Details of the conduit are difficult to appreciate in the drawings, but conduit 445*a* may be installed along a surface of sleeve and have a fluid communication opening at one end to annulus 443 and a fluid communication opening at the opposite end to chamber 447. In the illustrated embodiment, conduit 445*a* is installed on the outer surface of sleeve 440 in a groove 445*b* formed therealong. By positioning of conduit 445*a* in groove 445*b*, the conduit is provided protection against the rigors of wellbore operations. Holes are opened through sleeve to provide access between the conduit's inner flow passage and both annulus 443 and chamber 447, respectively.

Annulus pressure is communicated to face 420 through unsealed interfaces such as the space 451 between the sleeve and set screws 424 or through other non pressure holding interfaces in sleeve that are open to face 420.

Sleeve 440 can be moved along the tubular body by creating a pressure differential between faces 449 and 420, for example by pressuring up the tubing string to increase the pressure against face 449, while that tubing pressure is sealed from communication to the annulus about the tool and, thereby, to face 420. Set screws 424 in glands 424*a* or other releasable setting devices retain the sleeve in a selected position on the tubular body, for example, in the run in position (FIG. 19) and until it is desired to begin the process to open the ports by generating a pressure differential sufficient to overcome the holding force of set screws (FIG. 21).

Driver, herein shown in the form of spring 416 (but alternately may be in the form of an atmospheric chamber, a pressurized chamber, an elastomeric insert, etc.), can be installed to act between the sleeve and tubular body to drive the sleeve once it is initially released to move (by application of a pressure differential). Spring 416 is a compression spring (biased against compression) which acts, when it is free to do so (FIG. 22), to drive the sleeve to reduce the volume of chamber 447, which is reverse to the direction traveled when the tubing pressure initially moves the sleeve.

Figure 21:
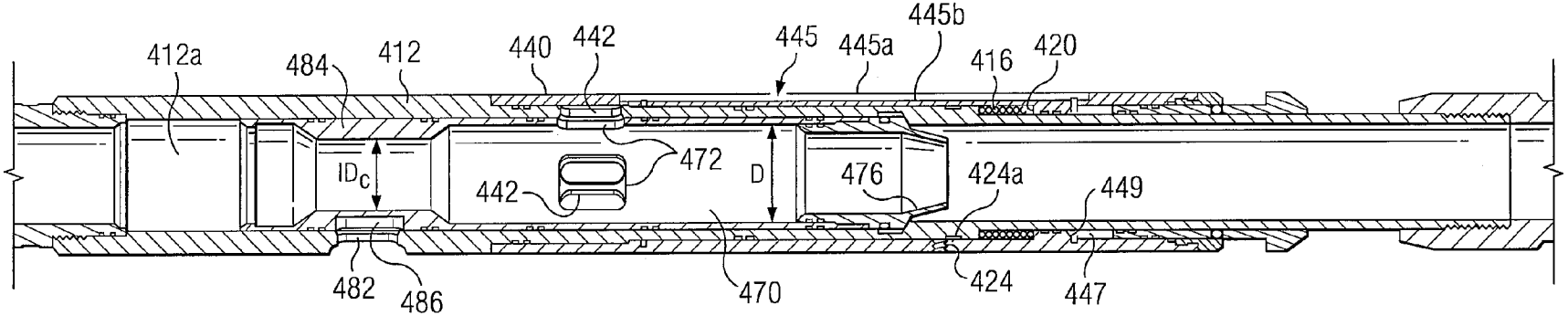
FIG. 21 is a view of the tool of FIG. 19 in an activated position.
Figure 22A:
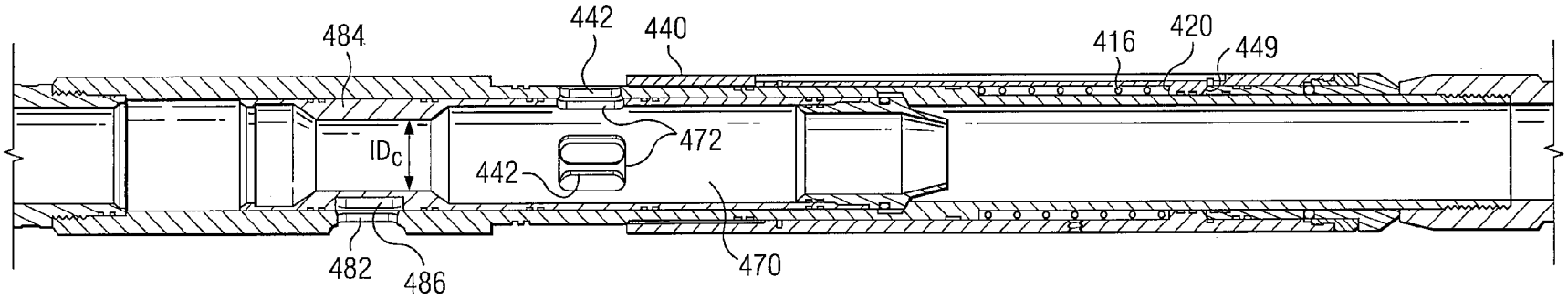
FIGS. 22A and 22B are sectional and front elevation views, respectively, of the tool of FIG. 19 in a port open position.
Figure 22B:
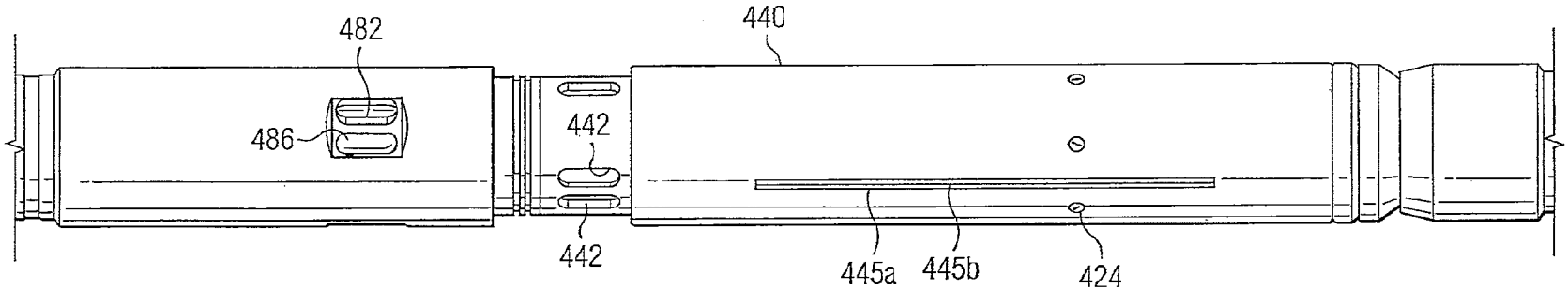
Figure 23:
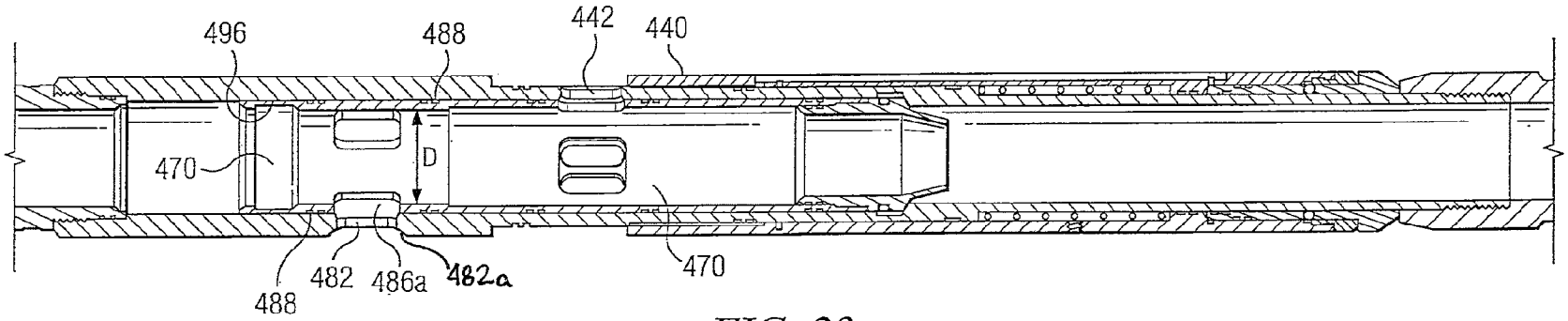
FIG. 23 is a view of the tool of FIG. 19 in a production position.

Movement of the illustrated sleeve 440 to open ports 442 proceeds as follows, first a pressure differential may be set up across faces 449, 420 with the pressure acting against face 449 exceeding that acting against face 420 (FIG. 20-21). This pressure overcomes the holding force of screws 424 and drives the sleeve towards the low pressure side, which compresses spring 416 (FIG. 21). As long as the tubing pressure is held in excess of the force of spring to expand against its compressed state, the sleeve remains driven towards the low pressure side. However, when the pressure differential dissipates to the point that the spring force is greater than the force exerted by tubing pressure, the sleeve moves back by the driving force of the spring toward chamber 447 (FIG. 22). This movement opens the sub's ports to fluid flow therethrough by retracting the sleeve from a covering position over ports 442 through the tubular body.

In view of the foregoing, it can be now more fully appreciated that isolation sleeve 470 may be positioned to close or positioned to allow access of tubing pressure to the fluid channel arising through ports 442, according to the position of access ports 472 on the sleeve. When access ports 472 are in a position preventing fluid access to ports 442, any pressure fluctuations in the tubing string inner diameter through inner bore 412*a* are isolated from sleeve 440. However, when access ports 472 are at least to some degree open to ports 442, sleeve 440 may be acted upon by fluid pressure to retract the sleeve from ports 442 to open the ports to fluid flow, for formation treatment or production, through ports 472 and 442.

In some embodiments, it may be useful for the ball to continue past its seat after the sleeve has been moved. In such embodiments, yieldable seats or balls may be employed which allow a pressure differential to be set up to move the sleeve, but when the sleeve is stopped against further movement, such as by stopping against shoulder 478, the ball can pass through the seat. For example, the illustrated embodiment includes seat 476 that is yieldable. The ball 474 is capable of passing through the seat after the sleeve has shouldered into a stopped position. Thus, while the ball is seated in FIG. 20, the ball has passed through the seat in FIG. 21.

An isolator may be employed to open access to one sleeve at a time. If the isolator is a sleeve for example, the ball may land in the sleeve, move the sleeve and seal off fluid flow past the sleeve. If there is more than one isolator sleeve in a tubing string, the seats 476 of the sleeves may be differently sized such that different sized balls will seal in each of the two or more sleeves. In such an embodiment, the sleeve with the smallest ball is positioned below sleeves with larger seats in order to ensure that the ball capable of seating and sealing therein can pass through the seats above. In particular, where there are a plurality of sleeves with ball seats, each one that is to be actuated independently of the others and is progressively closer to surface, has a seat formed larger than the one below it in order to ensure that the balls can pass through any seats above that ball's intended seat.

In some embodiments, a plurality of isolators may be employed that are actuated by a common function. For example, if it is desired to segment the well, such as for example as shown in FIG. 4, into a plurality of areas with one or more selected fluid delivery mechanisms therein, one or more of the selected fluid delivery mechanisms in a selected area may have an isolator actuated by a common function. Using the illustrated embodiment of FIG. 19 as a reference, for example, a plurality of isolator sleeves may be employed in an area of the well that are each actuated by the same ball. In such an embodiment, the above-noted yieldable seats or balls may be employed which allow a pressure differential to be set up to move the sleeve, but when the sleeve is stopped against further movement, such as by stopping against shoulder 478, the ball can pass through the seat and move to the next seat, land therein to create a seal therewith and move that sleeve. This single ball driven multiple sleeve movement can continue until all the sleeves of interest are moved by the ball. Since it may be useful to have the ball create a final seal in the tubing string to restrict fluid access to structures above the finally seated ball, the final sleeve seat or a seat fixed below the final sleeve seat may be formed to prevent the ball from passing therethrough. While the ball and/or the seat may be yieldable, selecting the seat to be yieldable, rather than the ball may ensure that the finally seated ball is less likely to be expelled through its final seat and may avoid problems that may arise by plastic deformation of the ball. For example, a yieldable ball seat may be yieldable by material selection and/or by mechanical mechanisms. For example, the ball seat may be formed of a material yieldable under the intended pressure conditions such as an elastomer, a plastic, a soft metal, etc. that can elastically or plastically deform to allow a ball to pass. Alternately or in addition, the seat may include a solid or segmented surface with a biasing mechanism or failable component that can be overcome, biased out of the way or broken off, to allow the ball to pass. For a better understanding, reference may be made to FIG. 5 showing three areas I, II and VII in a well. While the apparatus of FIG. 5 has previously been described with respect to a foregoing tool embodiment of FIGS. 10 to 13, FIG. 5 can be useful also to illustrate possible operations with the tool embodiment of FIGS. 19 to 23. The apparatus 120 of FIG. 5 is initially positioned in a hydrocarbon well with each of the packers 124 being in a non-actuated state. The distal end of the tubing string comprising the apparatus 120 may be initially open to facilitate the flow of fluid through the tubing string and then back through at least a portion of the well annulus toward surface to condition the well. Of course, the end of the tubing string can alternately be closed during run in. However in the illustrated embodiment, a ball 126 is eventually passed through the tubing string until it engages a ball receiving mechanism 128, such as a seat, thereby closing the distal end of the tubing string. After the ball 126 has been seated, the tubing string is pressurized thereby actuating the packers 124. FIG. 5 illustrates the apparatus 120 after ball 126 has landed and the packers 124 have been actuated.

All of the fracing mechanisms in a single area can be opened at the same time. In other words, fracing mechanisms 121 A, B, C and D that reside in Area I (the area nearest the lower end of the well) all can be opened at the same time which occurs after pressurization takes place after ball 126 seats. The fracing mechanisms 122 A, B, C and D, etc. of Areas II, III, etc. remain closed during the opening of fracing mechanisms 121 of Area I and possibly even during any fracing therethrough. Once the Area I mechanisms are open, and if desired the frac is complete, it may be desired to open mechanisms 122 A, B, C and D, etc. of Areas II. To do so, we will assume here that each of the mechanisms include a sleeve-type isolator that isolates the pressure cycling, port opening sleeve from the tubing pressure such as for example shown in FIG. 19. The isolators in this embodiment may include a sleeve with a yieldable seat. To open the frac mechanisms, the isolation sleeves must be moved to permit tubing pressure to be communicated to the pressure cycling port-opening sleeves that control the open/closed condition of frac ports 142 A, B, C and D. To open the sleeves, another ball 126*a* (illustrated in FIG. 7) is dropped that lands in the seat of each isolator sleeve and moves each isolator sleeve to a position permitting communication to the pressure cycling sleeve. In particular, ball 126*a* would (i) first land in the seat of the isolator sleeve of mechanism 122 at port 142D, (ii) seal against the seat of that mechanism, (iii) shift, as driven by fluid pressure, the isolator sleeve, (iv) pass through that seat, (v) flow and land in the seat of the isolator sleeve of the next mechanism 122 at port 142C, (vi) seal against the seat of that isolator sleeve, (vii) shift, as driven by fluid pressure, the isolator sleeve, (viii) pass through that seat and so on until it passes through the seat of the last isolator sleeve at mechanism 122 of port 142A and arrives at ball receiving mechanism 128*a* above the top fracing mechanism 121D in Area I. In this position, ball 126*a* provides three functions; first, it has opened the isolator sleeves that have seats sized to accept and temporarily retain ball 126*a*; second, it has seated and created a seal between Area II and the open fracing mechanisms 121 in Area I; and third, it allows pressure to be applied and increased in the tubing string adjacent to the fracing mechanisms 122 that are located above Area I. It is to be appreciated that the last isolator sleeve seat could alternately be formed to retain the ball, rather than allowing it to pass to ball retainer 128*a* and still fulfill these three functions. After ball 126*a* lands in ball retainer 128*a*, the tubing pressure can again be elevated and this pressurization communicates to the pressure cycling sleeves to open all of the fracing ports 142 A, B, C and D in Area II (which is located adjacent to and up-hole from Area I in the string). At the same time, the fracing mechanisms in Area III and higher remain closed since their isolator sleeves remain positioned thereover: isolating their pressure cycling port-opening sleeves from tubing pressure. After completing a frac in Area II, another ball may be dropped that is sized to pass through the isolator sleeve seats and ball retaining mechanisms (if any) of Areas IV to VIII and to land in and seal against the isolator sleeve seats of the fracing mechanisms 122 of Area III. That ball also finally seats above the fracing mechanisms in Area II and below the fracing mechanisms in Area III, the string is pressured up to open the frac ports of Area III, and so on until all ports of interest are opened, such as in this illustrated embodiment, up to and including the frac ports 142 A, B, C and D of Area VIII.

The fracing mechanisms 121 of Area I may be as described above in FIG. 1 or 2, such that they may be opened all at once by a single pressure pulse. For example, the mechanisms may be released to open by an increase in tubing pressure as affected after ball 126 seats and when packers are being set and may be driven to open as tubing pressure is released. However, the fracing mechanisms 122 of the remaining areas remain closed during the initial pressure cycle and can only open after their isolator sleeves are opened and tubing pressure is increased and then dissipated to actuate their pressure cycling sleeves to open their ports.

The embodiment of FIGS. 19 to 23 further offer a feature facilitating production through the string after the fracing operation is complete. While production fluids may pass through aligned ports 442, 472, the illustrated tool includes further ports that may be opened only when it is desired to have greater access between inner bore 412*a* and the formation about the string. As such, the embodiment of FIGS. 19 to 23 includes production ports 482 (see FIG. 21) that may be opened when greater access through the tubular body 412 is desired between its inner bore 412*a* and its outer surface 412*c*. Production ports 482 may be normally covered by isolation sleeve 470. However, a sleeve of the sub may be openable by actuation or removal of a component thereof to open access from inner bore 412*a* to outer surface 412*c* through ports 482. Sleeve 470 in the illustrated embodiment includes a removable component in the form of a constriction 484 and opposite indentation 486 that is positioned to lie adjacent, in this embodiment radially inwardly of, the production ports. Constriction 484, which protrudes into the inner bore 412*a* has an inner diameter $ID_C$ less than the desired full open bore diameter D of the tubing string and indentation 486 protrudes beyond the full open bore diameter of the tubing string. Constriction 484 can be removed by milling through the inner bore to open up the inner diameter $ID_C$ at constriction to full bore. In so doing, access will be made to indentation 486, which will form an opening 486*a* through the sleeve where the indentation had protruded beyond diameter D. Milling axially through the inner diameter of the tubing string may be a desired step in any event to remove other ID obstructions such as seats 476.

Seals 488 may be positioned on sleeve 470 to provide seals against fluid leakage between the sleeve and body 412 between ports 482 and inner bore 412*a*.

Even if the sub does not include an isolation sleeve, a sleeve may be employed that is operable, as noted above to open production ports. For example, a production port may be positioned through the tubular body of the tool of FIG. 1, which is openable by removal of a portion of that tool's sleeve 14.

Sleeve 470 may be configured to be recloseable over ports 442 and/or 482. In particular, sleeve 470 may be moveable to overlie one or both of ports 442, 482. For example, in the illustrated embodiment, sleeve may include a profiled neck 496 formed for engagement by a pulling tool, such that the sleeve can be engaged by a tool and pulled up to reclose the ports. The position of the ports through the tubular body and seals on sleeve may be selected to permit closure and fluid sealing. If it is desired to later open the ports again, the isolator sleeve can be moved, as by use of a manipulator tool, back into a port-open position.

If desired, an inflow control device may be positioned to act on fluids passing through one or more of ports 442, 482. In one embodiment, an inflow control device, generally indicated as 482*a*, such as a screen or a choke, such as an ICD, can be provided to act on fluids passing through the production ports 482 and the sub can be configured such that flow from outer surface 412*c* to inner bore 412*a* can only be through production ports and the inflow control device installed therein.

If there are a plurality of sleeves along a length of a tubing string, the chokes may be selected to achieve a production profile. In particular, some chokes may allow greater flow than others to control the rate of production along a plurality of segments in the well.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A hydraulically actuable sleeve valve comprising:

a tubular segment including a wall defining therein an inner bore;

a port through the wall of the tubular segment;

a sleeve supported by the tubular segment and installed to be axially moveable relative to the tubular segment from a first position covering the port to a second position and to a third position away from a covering position over the port, the sleeve including a first piston face open to tubing pressure and a second piston face open to annular pressure, such that a pressure differential can be set up between the first piston face and the second piston face to drive the sleeve toward a low pressure side from the first position into the second position with the sleeve continuing to cover the port; and a driver configured to apply a driver force to the sleeve to move the sleeve from the second position into the third position, the driver being unable to move the sleeve until the pressure differential is substantially dissipated such that the driver force is greater than a force applied to the sleeve by the pressure differential between the first piston face and the second piston face.

2. The hydraulically actuable sleeve valve of claim 1, further comprising a releasable setting device to releasably hold the sleeve in the first position and the driver is unable to move the sleeve until the releasable setting device is released.

3. The hydraulically actuable sleeve valve of claim 1, further comprising a lock to resist movement of the sleeve from the third position to the first position.

4. The hydraulically actuable sleeve valve of claim 3, wherein the lock is biased to move into a locking position as the sleeve moves substantially into the third position.

5. The hydraulically actuable sleeve valve of claim 3, wherein the lock is a c-ring biased to expand into a locking position between the sleeve and the tubular segment when the sleeve moves substantially into the third position.

6. The hydraulically actuable sleeve valve of claim 1, further comprising a J-slot between the tubular segment and the sleeve to restrict the sleeve from moving from the second position to the third position until after a selected plurality of pressure cycles drives the sleeve through a plurality of intermediate positions between the second position and the third position.

7. The hydraulically actuable sleeve valve of claim 1, wherein the driver is a sealed pressure chamber allowing hydrostatic pressure to create a pressure differential across the sleeve to move the sleeve toward the sealed pressure chamber.

8. The hydraulically actuable sleeve valve of claim 1, further comprising a pressure isolator sealing tubing pressure from accessing the first piston face, the pressure isolator being openable to permit tubing pressure to be communicated to the first piston face.

9. The hydraulically actuable sleeve valve of claim 8, wherein the pressure isolator is an isolation sleeve positioned to seal access between the inner bore and the first piston face, and is moveable along the tubular segment to permit tubing pressure to be communicated from the inner bore to the first piston face.

10. The hydraulically actuable sleeve valve of claim 9, further comprising a second port through the wall of the tubular segment, the second port covered by the isolation sleeve and a component on the isolation sleeve positionable adjacent the second port, the component being removable from the isolation sleeve to open the second port to fluid flow therethrough.

11. The hydraulically actuable sleeve valve of claim 1, further comprising a second port through the wall of the tubular segment and covered by the sleeve and a component on the sleeve positionable adjacent the second port, the component being removable from the sleeve to open the second port to fluid flow therethrough.

12. The hydraulically actuable sleeve valve of claim 11, further comprising an inflow control device positioned to control fluid flow through the second port.

13. A method of accessing a hydrocarbon laden formation, comprising:

running a tubing string into a wellbore extending into the hydrocarbon laden formation, the tubing string comprising a plurality of fluid flow regulating mechanisms grouped into a plurality of areas including a first area including one or more of the plurality of fluid flow regulating mechanisms and a second area including one or more of the plurality of fluid flow regulating mechanisms;

actuating substantially simultaneously all of the fluid flow regulating mechanisms of the first area to access the hydrocarbon laden formation along the first area; and actuating substantially simultaneously all of the fluid flow regulating mechanisms of the second area to access the hydrocarbon laden formation along the second area.

14. The method of accessing the hydrocarbon laden formation according to claim 13, further comprising individually selecting the volume of flow through each of the flow regulating mechanisms of a selected one of the first area and the second area depending upon the formation geology of a fracing mechanism area.

15. The method of accessing the hydrocarbon laden formation according to claim 13, wherein the tubing string further comprises a plurality of hydraulically actuated packers; and wherein the method further comprises, after positioning the tubing string, actuating the plurality of hydraulically actuated packers to seal an annulus between the tubing string and the wellbore.

16. A sleeve valve sub comprising:

a tubular segment including a wall defining therein an inner bore;

a first port through the wall of the tubular segment;

a second port through the wall of the tubular segment; and a sleeve supported by the tubular segment and installed to be axially moveable relative to the tubular segment from a first position covering the first port to a second position away from a covering position over the first port, the sleeve covering the second port in the first position and the second position, the sleeve including an inner facing surface defining a full bore diameter, an inner diameter constriction on the inner diameter of the sleeve having a diameter less than the full bore diameter; an outer facing surface, an indentation on the outer facing surface radially aligned with the inner diameter constriction, the indentation defined by an extension of the outer facing surface protruding inwardly of the full bore diameter, the indentation being positionable over the second port when the sleeve is in the second position such that the second port is openable to fluid flow therethrough by removal of the inner diameter constriction.

* * * * *